US009234491B2

(12) United States Patent
Aochi et al.

(10) Patent No.: US 9,234,491 B2
(45) Date of Patent: Jan. 12, 2016

(54) SPARK PLUG FOR INTERNAL COMBUSTION ENGINE

(71) Applicants: NIPPON SOKEN, INC., Nishio, Aichi-pref. (JP); DENSO CORPORATION, Kariya, Aichi-pref. (JP)

(72) Inventors: Takanobu Aochi, Nishio (JP); Masamichi Shibata, Toyota (JP); Noriaki Nishio, Ichinomiya (JP); Kaori Doi, Kariya (JP)

(73) Assignees: NIPPON SOKEN, INC., Nishio (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 14/718,783

(22) Filed: May 21, 2015

(65) Prior Publication Data

US 2015/0337792 A1 Nov. 26, 2015

(30) Foreign Application Priority Data

May 22, 2014 (JP) ..... 2014-106281

(51) Int. Cl.

| | |
|---|---|
| ***H01T 13/20*** | (2006.01) |
| ***F02P 15/00*** | (2006.01) |
| ***H01T 13/02*** | (2006.01) |

(52) U.S. Cl.

CPC ..... *F02P 15/001* (2013.01); *H01T 13/02* (2013.01)

(58) Field of Classification Search

CPC ..... F02P 15/001; H01T 3/02; H01T 3/32

See application file for complete search history.

(56) References Cited

U.S. PATENT DOCUMENTS

2013/0015755 A1* 1/2013 Inohara ..... H01T 13/32 313/141

FOREIGN PATENT DOCUMENTS

| | | |
|---|---|---|
| JP | 09-148045 | 6/1997 |
| JP | 2013-004412 | 1/2013 |
| JP | 2014-116181 | 6/2014 |

* cited by examiner

*Primary Examiner* — Nimeshkumar Patel
*Assistant Examiner* — Jacob R Stern
(74) *Attorney, Agent, or Firm* — Nixon & Vanderhye PC

(57) ABSTRACT

A spark plug for an internal combustion engine includes a tubular housing, a tubular insulator, a center electrode, a ground electrode and a guide member. The guide member is configured to guide the flow of an air-fuel mixture in a combustion chamber of the engine to a spark gap formed between the center electrode and the ground electrode. Moreover, in the spark plug, the following dimensional relationships are satisfied: $b \geq -67.8 \times (a/D) + 27.4$; $b \leq -123.7 \times (a/D) + 64.5$; $-0.4 \leq (a/D) \leq 0.4$; and $0° \leq b \leq 90°$. Further, with an oblique angle θ being in the range of 0 to 30°, the following dimensional relationship is also satisfied: $0.8 \leq r/R \leq 1$. Consequently, the spark plug can secure, with a simple configuration, a stable ignition capability regardless of the mounting posture of the spark plug to the engine.

16 Claims, 23 Drawing Sheets

SPARK PLUG FOR INTERNAL COMBUSTION ENGINE

CROSS-REFERENCE TO RELATED APPLICATION

This application is based on and claims priority from Japanese Patent Application No. 2014-106281 filed on May 22, 2014, the content of which is hereby incorporated by reference in its entirety into this application.

BACKGROUND

1. Technical Field

The present invention relates to spark plugs for internal combustion engines.

2. Description of the Related Art

As ignition means in internal combustion engines, such as engines of motor vehicles, there are used spark plugs which have a spark gap formed between a center electrode and a ground electrode that are axially opposed to each other. Those spark plugs discharge a spark across the spark gap, thereby igniting an air-fuel mixture in a combustion chamber.

In the combustion chamber, them is formed a flow of the air-fuel mixture, such as a swirl flow or tumble flow. With the flow of the air-fuel mixture moderately flowing also in the spark gap, it is possible to ensure the ignition capability of the spark plug (i.e., the capability of the spark plug to ignite the air-fuel mixture).

However, depending on the mounting posture (or mounting state) of the spark plug to the internal combustion engine, part of the ground electrode, which is joined to a distal end of a housing of the spark plug, may be located upstream of the spark gap with respect to the flow of the air-fuel mixture. In this case, the flow of the air-fuel mixture in the combustion chamber may be blocked by the ground electrode, thereby being stagnated in the vicinity of the spark gap. As a result, the ignition capability of the spark plug may be lowered. That is, the ignition capability of the spark plug may vary depending on the mounting posture of the spark plug to the internal combustion engine. In particular, in lean-burn internal combustion engines which have been widely used in recent years, the combustion stability may be lowered depending on the mounting posture of the spark plug.

However, it is generally difficult to control the mounting posture of a spark plug to an internal combustion engine, i.e., difficult to control the circumferential position of the ground electrode of the spark plug relative to the internal combustion engine. This is because the mounting posture of the spark plug to the internal combustion engine varies depending on the state of formation of a male-threaded portion in the housing of the spark plug and the degree of fastening the male-threaded portion into a female-threaded bore formed in the engine.

To solve the above problem, Japanese Patent Application Publication No. JPH09148045A discloses two techniques for preventing the flow of the air-fuel mixture from being blocked by the ground electrode. The first technique is to form a slot-like hole in the ground electrode. The second technique is to fix the ground electrode to the housing through a plurality of thin plate-shaped members.

However, in the case of applying the first technique, the strength of the ground electrode may be lowered due to the formation of the slot-like hole in the ground electrode. Moreover, if the ground electrode was formed to have a large thickness for ensuring the strength thereof, it would become easier for the ground electrode to impede the flow of the air-fuel mixture in the combustion chamber.

On the other hand, in the case of applying the second technique, the shape of the ground electrode is complicated, thus increasing the manufacturing cost and lowering the productivity.

SUMMARY

According to exemplary embodiments, there is provided a spark plug for an internal combustion engine. The spark plug includes a tubular housing, a tubular insulator, a center electrode, a ground electrode and a guide member. The insulator is retained in the housing. The center electrode is secured in the insulator with a distal end portion of the center electrode protruding outside the insulator. The ground electrode has a standing portion that stands distalward from a distal end of the housing and an opposing portion that opposes the distal end portion of the center electrode in an axial direction of the spark plug through a spark gap formed therebetween. The guide member is configured to guide the flow of an air-fuel mixture in a combustion chamber of the internal combustion engine to the spark gap. The guide member protrudes distalward from the distal end of the housing at a different circumferential position from the ground electrode. The guide member has a guide surface that faces the ground electrode in a circumferential direction of the spark plug.

Moreover, on a projection plane which is defined to extend perpendicular to the axial direction of the spark plug through the spark gap and on which the above components of the spark plug are projected, the following dimensional relationships are satisfied:

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° \leq b \leq 0.90° \quad (4)$$

where: a is a distance between a center point of the center electrode and an intersection point between straight lines L and M, the straight line L extending through both a center of the standing portion of the ground electrode in the circumferential direction of the spark plug and the center point of the center electrode, the straight line M extending through the guide surface of the guide member, the distance a being positive on the side of the center point of the center electrode away from the standing portion of the ground electrode and negative on the side of the center point of the center electrode approaching the standing portion of the ground electrode; b is an angle between the straight lines L and M; and D is an outer diameter of the housing.

Furthermore, in the spark plug, a first reference plane P1 is defined to include both a central axis of the center electrode and the straight line L. A second reference plane P2 is defined to extend perpendicular to the axial direction of the spark plug through a distal end of the center electrode. A third reference plane P3 is defined to be orthogonal to the first reference plane P1 and extend obliquely at an oblique angle θ with respect to the second reference plane P2 through the intersection between the central axis of the center electrode and the second reference plane P2. The oblique angle θ is positive when the third reference plane P3 is inclined with respect to the second reference plane P2 in a direction causing a distal-side face of the third reference plane P3 not to face the standing portion of the ground electrode. With the oblique angle θ being in a range of 0 to 30° and projecting on the projection plane a cross section of the ground electrode and a cross section of the guide member both of which are taken along the third reference plane P3, the following dimensional relationship is further satisfied:

$$0.8 \leq r/R \leq 1 \quad (5)$$

where r is a distance on the projection plane between the central axis of the center electrode and an outer side of the cross section of the ground electrode, and R is a distance on the projection plane between the central axis of the center electrode and a guide surface-side outer corner of the cross section of the guide member.

The above spark plug has the following advantages.

First, with the guide member, it is possible to guide the flow of the air-fuel mixture in the combustion chamber of the engine to the spark gap regardless of the mounting posture of the spark plug to the engine.

More specifically, even when the standing portion of the ground electrode is located upstream of the spark gap with respect to the flow of the air-fuel mixture in the combustion chamber, it is still possible to guide the flow of the air-fuel mixture passing by the standing portion of the ground electrode to the spark gap by the guide member. Consequently, it is possible to suppress stagnation of the flow of the air-fuel mixture in the vicinity of the spark gap. As a result, it is possible to secure a stable ignition capability of the spark plug.

Secondly, the guide surface of the guide member is arranged so as to satisfy all of the dimensional relationships (1)-(4). Consequently, when the standing portion of the ground electrode is located upstream of the spark gap with respect to the flow of the air-fuel mixture in the combustion chamber, it is possible for the guide surface of the guide member to more effectively guide the flow of the air-fuel mixture to the spark gap. As a result, it is possible to sufficiently extend the length of a spark discharged across the spark gap and thereby reliably ensure the ignition capability of the spark plug regardless of the mounting posture of the spark plug to the engine.

Thirdly, the guide member is realized by the simple configuration of arranging it to protrude distalward from the distal end of the housing. That is, with the guide member having the simple configuration, it is unnecessary to specially devise the shape of the ground electrode and unnecessary to make the shape of the ground electrode complicated.

Finally, the ground electrode and the guide member are arranged so as to satisfy the dimensional relationship (5) with the oblique angle θ being in the range of 0 to 30°. Consequently, even when the flow of the air-fuel mixture flowing to the distal part of the spark plug has a vector component toward the proximal side, it is still possible to suitably guide the flow of the air-fuel mixture to the spark gap.

To sum up, the spark plug can secure, with a simple configuration, a stable ignition capability regardless of the mounting posture of the spark plug to the engine.

It is preferable that the following dimensional relationship is further satisfied:

$$b \leq -123.4 \times (a/D) + 53.7 \quad (6)$$

It is also preferable that the following dimensional relationship is further satisfied:

$$b \geq -123.1 \times (a/D) + 30.0 \quad (7)$$

It is also preferable that the following dimensional relationship is further satisfied:

$$-0.3 \leq (a/D) \leq 0.3 \quad (8)$$

The standing portion of the ground electrode may include an axially-extending part that extends from the distal end of the housing in the axial direction of the spark plug. In this case, it is preferable that the following dimensional relationship is further satisfied:

$$h2 \geq h1 + R \times \tan 30° \quad (9)$$

where h1 is the axial distance from the distal end of the housing to the distal end of the center electrode, and h2 is the axial length of the axially-extending part of the standing portion of the ground electrode.

The guide member may extend obliquely with respect to the axial direction of the spark plug so that the distance between the guide member and the central axis of the center electrode decreases in the distalward direction.

Otherwise, the guide member may extend in the axial direction of the spark plug.

It is preferable that $0.85 \leq r/R \leq 1$.

It is more preferable that $0.9 \leq r/R \leq 1$.

Preferably, the guide member has its distal end located at the same axial position as or proximalward from a distal end of the ground electrode and at the same axial position as or distalward from a distal and of the insulator.

It is preferable that the circumferential width of the guide member is smaller than the circumferential width of the standing portion of the ground electrode.

It is also preferable that the radial width of the guide member is greater than the circumferential width of the guide member.

BRIEF DESCRIPTION OF THE DRAWINGS

The present invention will be understood more fully from the detailed description given hereinafter and from the accompanying drawings of exemplary embodiments, which, however, should not be taken to limit the present invention to the specific embodiments but are for the purpose of explanation and understanding only.

In the accompanying drawings.

DESCRIPTION OF EMBODIMENTS

Figure 1:
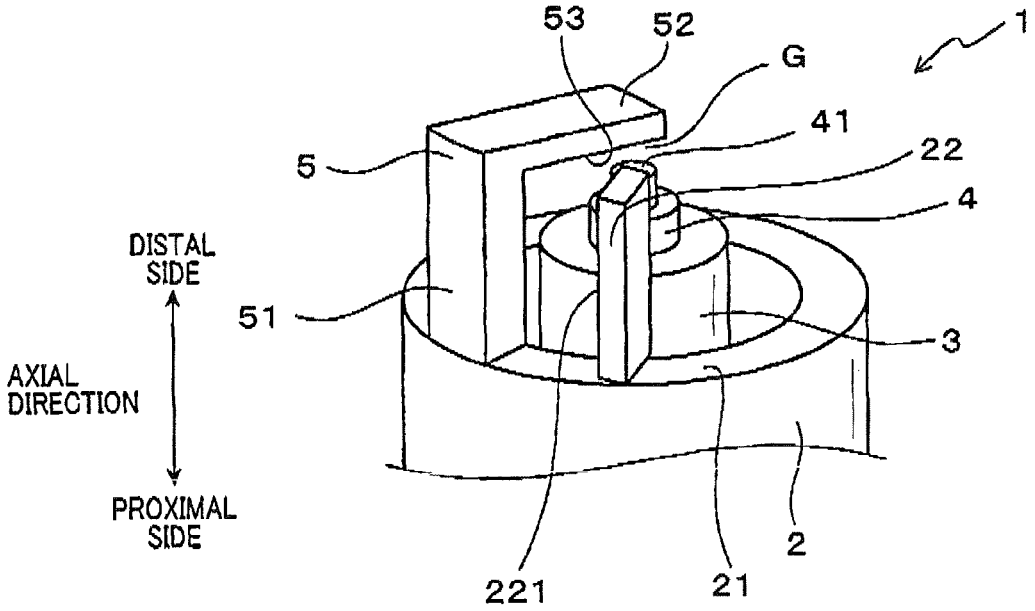
FIG. 1 is a perspective view of a distal part of a spark plug according to a first embodiment.

Exemplary embodiments will be described hereinafter with reference to FIGS. 1-37. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

First Embodiment

This embodiment illustrates a spark plug 1 that is designed to be used as ignition means in an internal combustion engine of, for example, a motor vehicle.

More specifically, the spark plug 1 is designed to ignite an air-fuel mixture in a combustion chamber of the engine. The spark plug 1 has one axial end to be connected to an ignition coil (not shown) and the other axial end to be placed inside the combustion chamber. In addition, hereinafter, as shown in FIG. 1, the axial side where the spark plug 1 is to be connected to the ignition coil will be referred to as "proximal side"; the other axial side where the spark plug 1 is to be placed inside the combustion chamber will be referred to as "distal side".

Figure 2:
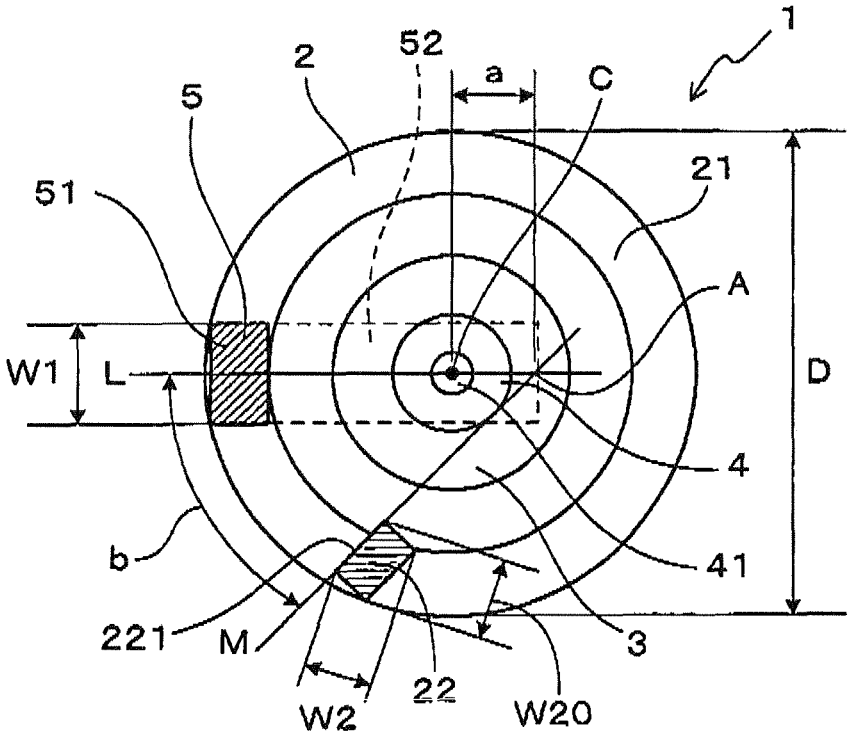
FIG. 2 is a cross-sectional view of the spark plug taken along a plane that extends perpendicular to an axial direction of the spark plug through a spark gap formed between center and ground electrodes of the spark plug.
Figure 3:
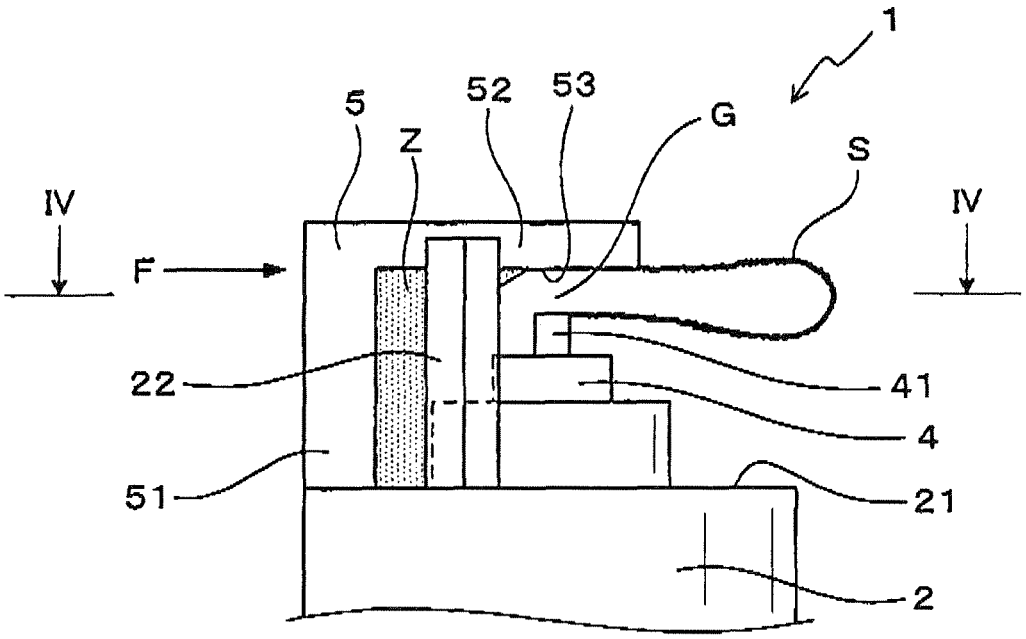
FIG. 3 is a side view of the distal part of the spark plug where a standing portion of the ground electrode is located upstream of the spark gap with respect to the flow of an air-fuel fixture in a combustion chamber of an internal combustion engine.

As shown in FIGS. 1-3, the spark plug 1 according to the present embodiment includes: a tubular housing (or metal shell) 2; a tubular insulator 3 retained in the housing 2; a center electrode 4 secured in the insulator 3 such that a distal end portion 41 of the center electrode 4 protrudes outside the insulator 3; and a ground electrode 5 configured to protrude distalward (i.e., toward the distal side) from a distal end 21 of the housing 2 and define a spark gap G between the center and ground electrodes 4 and 5.

Specifically, as shown in FIGS. 1 and 3, the ground electrode 5 is substantially L-shaped to have a standing portion 51 and an opposing portion 52. The standing portion 51 is provided to stand (or protrude) distalward from the distal end 21 of the housing 2. The opposing portion 52 extends perpendicular to the standing portion 51 and has an opposing surface 53 that opposes the distal end portion 41 of the center electrode 4 in the axial direction of the spark plug 1 through the spark gap G formed therebetween.

Moreover, the spark plug 1 according to the present embodiment further includes a guide member 22 for guiding the flow of the air-fuel mixture in the combustion chamber of the engine to the spark gap G. The guide member 22 protrudes distalward from the distal end 21 of the housing 2 at a different circumferential position from the standing portion 51 of the ground electrode 5. The guide member 22 has a flat guide surface 221 that faces the ground electrode 5 in the circumferential direction of the spark plug 1.

Furthermore, the spark plug 1 according to the present embodiment satisfies the following dimensional relationships (1)-(4).

Specifically, referring to FIG. 2, on a projection plane (i.e., the paper surface of FIG. 2) on which the components of the spark plug 1 are projected, let L represent a straight line extending through both the center of the standing portion 51 of the ground electrode 5 in the circumferential direction of the spark plug 1 and the center point C (or the central axis Y) of the center electrode 4, and let M represent a straight line extending through the guide surface 221 of the guide member 22. Here, the projection plane is defined to extend perpendicular to the axial direction of the spark plug 1 through the spark gap G. Moreover, on the projection plane, let a represent the distance between the center point C of the center electrode 4 and the intersection point A between the straight lines L and M, let b represent an angle between the straight lines L and M, and let D represent the outer diameter of the housing 2. In addition, let the distance a be positive on the side of the center point C of the center electrode 4 away from the standing portion 51 of the ground electrode 5 and be negative on the side of the center point C approaching the standing portion 51. Then, the parameters a, b and D satisfy the following dimensional relationships:

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° \leq b \leq 0.90° \quad (4)$$

The spark plug 1 according to the present embodiment further satisfies the following three-dimensional shape requirement.

Figure 5:
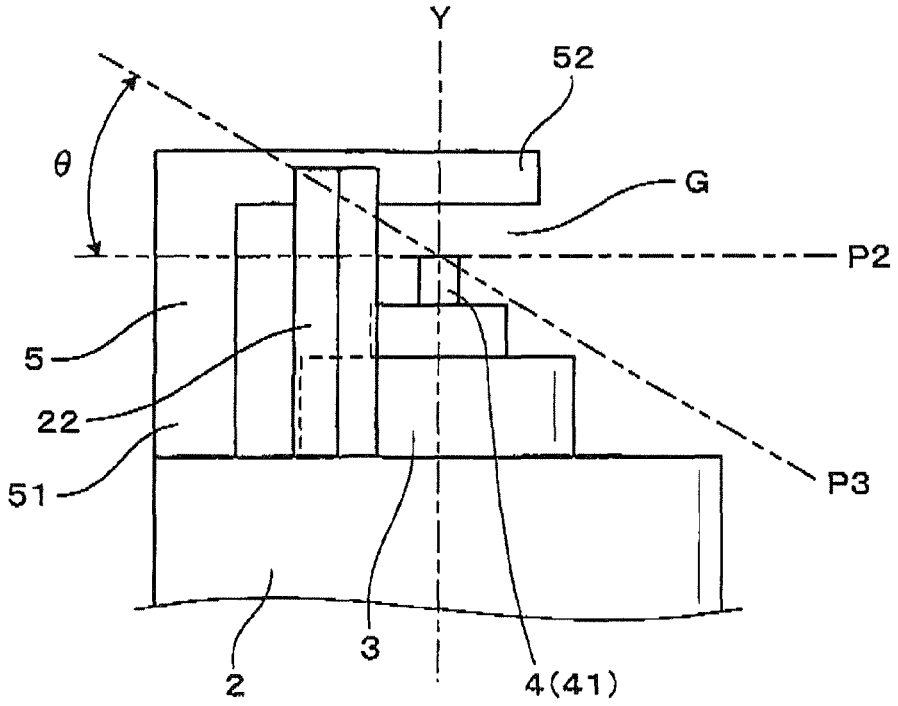
FIG. 5 is a schematic side view of the distal part of the spark plug illustrating a three-dimensional shape requirement for the spark plug.
Figure 6:
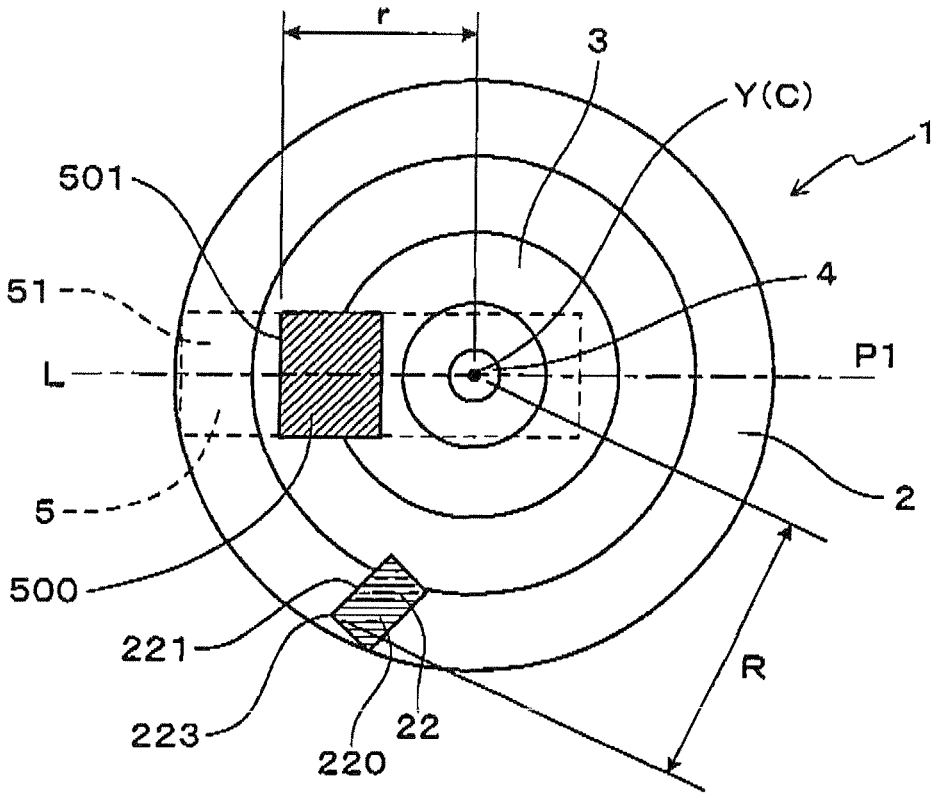
FIG. 6 is a schematic cross-sectional view of the distal part of the spark plug illustrating the three-dimensional shape requirement.

Specifically, referring to FIG. 6, let P1 represent a first reference plane that includes both the central axis Y of the center electrode 4 and the straight line L. Referring to FIG. 5, let P2 represent a second reference plane that extends perpendicular to the axial direction of the spark plug 1 (or to the central axis Y of the center electrode 4) through the distal end of the center electrode 4; let P3 represent a third reference plane that is orthogonal to the first reference plane P1 (i.e., the paper surface of FIG. 5) and extends obliquely at an oblique angle θ with respect to the second reference plane P2 through the intersection between the central axis Y of the center electrode 4 and the second reference plane P2. Further, let the oblique angle θ be positive when the third reference plane P3 is inclined with respect to the second reference plane P2 in a direction causing the distal-side face of the third reference plane P3 not to face the standing portion 51 of the ground electrode 5. In addition, let the oblique angle θ be 0° when the third reference plane P3 coincides with the second reference plane P2. In other words, the state of the third reference plane P3 coinciding with the second reference plane P2 may also be expressed as the third reference plane P3 extending obliquely at an oblique angle θ of 0° with respect to the second reference plane P2.

Moreover, referring to FIG. 6, with the oblique angle θ being in the range of 0 to 30° and projecting on the projection plane (i.e., the paper surface of FIG. 6) a cross section 500 of the ground electrode 5 and a cross section 220 of the guide member 22 both of which are taken along the third reference plane P3, the following dimensional relationship (5) is further satisfied:

$$0.8 \leq r/R \leq 1 \quad (5)$$

where r is the distance on the projection plane between the central axis Y of the center electrode 4 and an outer side 501 of the cross section 500 of the ground electrode 5, and R is the distance on the projection plane between the central axis Y of the center electrode 4 and the guide surface 221-side outer corner 223 of the cross section 220 of the guide member 22.

In addition, as described previously, the projection plane is defined to extend perpendicular to the axial direction of the spark plug 1 through the spark gap G.

If the oblique angle θ of the third reference plane P3 to the second reference plane P2 changes in the range of 0 to 30°, the projections of the cross section 500 of the ground electrode 5 and the cross section 220 of the guide member 22 on the projection plane may change in position and shape. Thus, both the distances r and R may also change. However, even in this case, the spark plug 1 is required to satisfy the above dimensional relationship (5).

That is, the requirement of satisfying the dimensional relationship (5) when the oblique angle θ takes any value in the range of 0 to 30° is simply referred to as the three-dimensional shape requirement.

In addition, in the present embodiment, the guide member 22 extends in the axial direction of the spark plug 1. Therefore, even if the oblique angle θ changes in the range of 0 to 30°, the position and shape of the projection of the cross section 220 of the guide member 22 on the projection plane remain unchanged. Thus, the distance R also remains unchanged. However, with the change in the oblique angle θ, the position and shape of the projection of the cross section 500 of the ground electrode 5 on the projection plane may change. Thus, the distance r may also change.

It is preferable that at least one of the following dimensional relationships (6) and (7) is further satisfied in addition to the above-described dimensional relationships (1)-(5). It is more preferable that both of the following dimensional relationships (6) and (7) are further satisfied in addition to the above-described dimensional relationships (1)-(5).

$$b \leq -123.4 \times (a/D) + 53.7 \quad (6)$$

$$b \geq -123.1 \times (a/D) + 30.0 \quad (7)$$

Moreover, it is further preferable that the following dimensional relationship (8) is also satisfied.

$$-0.3 \leq (a/D) \leq 0.3 \quad (8)$$

In the present embodiment, as shown in FIGS. 1 and 3, the guide member 22 extends in the axial direction of the spark plug 1. Moreover, the guide member 22 has its distal end located at the same axial position as or proximalward (i.e., toward the proximal side) from the distal end of the ground electrode 5 and at the same axial position as or distalward from the distal end of the insulator 3. The ground electrode 5 has its standing portion 51 extending in the axial direction of the spark plug 1 and its opposing portion 52 extending in a radial direction of the spark plug 1.

As shown in FIG. 2, the guide member 22 has, at an axial position closest to the spark gap G, a smaller circumferential width than the ground electrode 5. In the present embodiment, for the guide member 22, "an axial position closest to the spark gap G" is equivalent to "the same axial position as the spark gap G". Accordingly, at the same axial position as the spark gap G, the circumferential width W2 of the guide member 22 is smaller than the circumferential width W1 of the standing portion 51 of the ground electrode 5.

Moreover, at the same axial position as the spark gap G, the guide member 22 has a cross section perpendicular to the axial direction of the spark plug 1 such that the radial width W20 of the cross section is greater than the circumferential width W2 of the cross section. In other words, on the cross section, the radial width W20 of the guide member 22 is greater than the circumferential width W2 of the guide member 22.

As described previously, the guide member 22 has the guide surface 221 facing the ground electrode 5 in the circumferential direction of the spark plug 1. More specifically, the guide surface 221 of the guide member 22 faces the standing portion 51 of the ground electrode 5 in the circumferential direction of the spark plug 1 (or along the distal end 21 of the housing 2). Moreover, on the projection plane (or the paper surface of FIG. 2), the straight line M, which is defined to extend through the guide surface 221 of the guide member 22, does not necessarily have to pass through the spark gap G (or the distal end portion 41 of the center electrode 4). That is, the orientation and position of the straight line M may be suitably set in such a range as to satisfy the above-described dimensional relationships (1)-(5). In addition, it is preferable to set the orientation and position of the straight line M so as to also satisfy at least one of the above-described dimensional relationships (6)-(8).

In the present embodiment, as shown in FIGS. 1-2, the guide member 22 has the shape of a quadrangular prism so that the shape of a cross section of the guide member 22 perpendicular to the axial direction of the spark plug 1 is rectangular. Moreover, one of longer sides of the rectangular cross section is formed of the guide surface 221.

An example of the dimensions and materials of components of the spark plug 1 according to the present embodiment is given below. It should be noted that the dimensions and materials of components of the spark plug 1 are not limited to this example.

The outer diameter D of the housing 2 is equal to 10.2 mm. The radial thickness of the housing 2 at the distal and 21 of the housing 2 is equal to 1.4 mm. The radial width W20 of the guide member 22 is equal to 1.9 mm. The circumferential width W2 of the guide member 22 is equal to 1.3 mm. The circumferential width W1 of the standing portion 51 of the ground electrode 5 is equal to 2.6 mm.

The distal end portion 41 of the center electrode 4 protrudes distalward from the distal end of the insulator 3 by 1.5 mm. The size of the spark gap G is equal to 1.1 mm.

The distal and portion 41 of the center electrode 4 is constituted by a noble metal chip that is made, for example, of iridium. Both the housing 2 and the ground electrode 5 are made, for example, of a nickel alloy.

In addition, the above-described dimensions and materials are also used for sample spark plugs tested in an experiment which will be described later.

According to the present embodiment, it is possible to achieve the following advantageous effects.

In the present embodiment, the spark plug 1 includes the guide member 22. Consequently, it is possible to guide the flow F of the air-fuel mixture in the combustion chamber of the engine to the spark gap G regardless of the mounting posture of the spark plug 1 to the engine.

Figure 4:
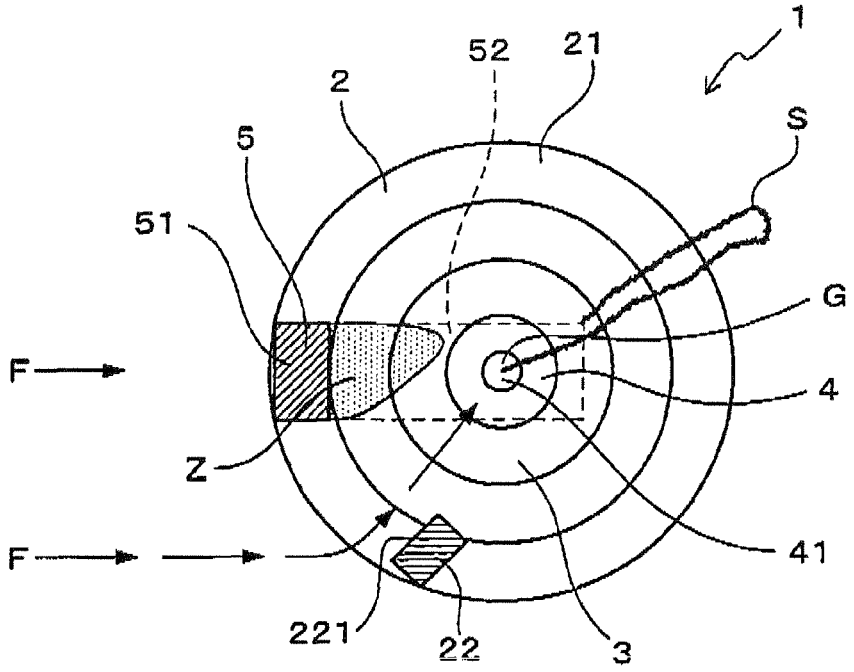
FIG. 4 is a cross-sectional view taken along the line IV-IV in FIG. 3.

Specifically, as shown in FIGS. 3-4, even when the standing portion 51 of the ground electrode 5 is located upstream of the spark gap G with respect to the flow F of the air-fuel mixture in the combustion chamber, it is still possible to guide the flow F of the air-fuel mixture passing by the standing portion 51 of the ground electrode 5 to the spark gap G by the guide member 22. Consequently, it is possible to suppress stagnation of the flow F of the air-fuel mixture in the vicinity of the spark gap G. As a result, it is possible to secure a stable ignition capability of the spark plug 1. In addition, in FIGS. 3-4 and other related figures, the region designated by Z represents stagnation of the flow F of the air-fuel mixture.

Moreover, in the present embodiment, the guide surface 221 of the guide member 22 is arranged so as to satisfy all of the dimensional relationships (1)-(4). Consequently, when the standing portion 51 of the ground electrode 5 is located upstream of the spark gap G with respect to the flow F of the air-fuel mixture in the combustion chamber, it is possible for the guide surface 221 of the guide member 22 to more effectively guide the flow F of the air-fuel mixture to the spark gap G. As a result, it is possible to sufficiently extend the length of a spark S discharged across the spark gap G and thereby reliably ensure the ignition capability of the spark plug 1 regardless of the mounting posture of the spark plug 1 to the engine.

Moreover, the guide member 22 is realized by the simple configuration of arranging it to protrude distalward from the distal end 21 of the housing 2. That is, with the guide member 22 having the simple configuration, it is unnecessary to specially devise the shape of the ground electrode 5 and unnecessary to make the shape of the ground electrode 5 complicated.

Furthermore, in the present embodiment, the ground electrode 5 and the guide member 22 are arranged so as to satisfy the above-described three-dimensional shape requirement. Consequently, even when the flow F of the air-fuel mixture flowing to the distal part of the spark plug 1 has a vector component toward the proximal side, it is still possible to suitably guide the flow F of the air-fuel mixture to the spark gap G.

Figure 7:
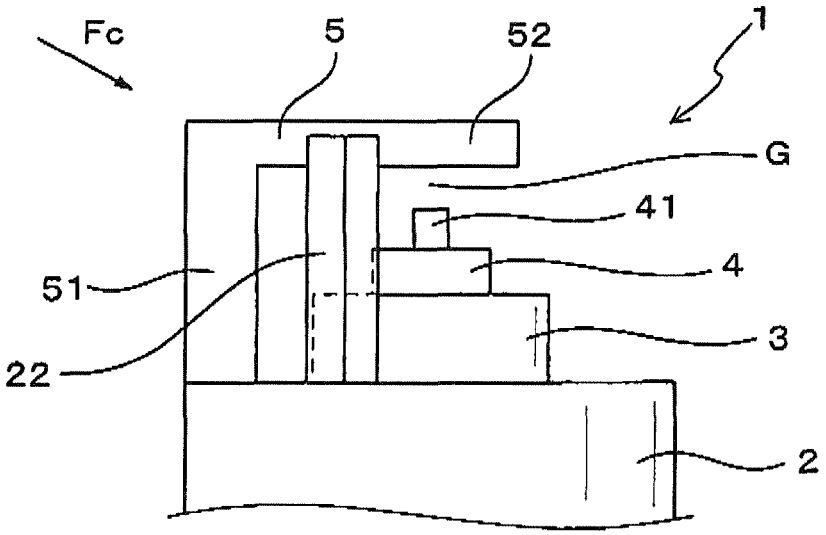
FIG. 7 is a schematic view illustrating the flow of the air-fuel mixture flowing to the distal part of the spark plug, the flow having a vector component toward the proximal side.

Specifically, the flow F of the air-fuel mixture flowing to the distal part of the spark plug 1 is not always in a direction perpendicular to the axial direction of the spark plug 1. Instead, the flow F of the air-fuel mixture flowing to the distal part of the spark plug 1 may be a flow Fc which has a vector component toward the proximal side in the axial direction of the spark plug 1 as shown in FIG. 7. In this case, depending on the shapes and positions of the ground electrode 5 and the guide member 22, it may be difficult to suitably guide the flow Fc to the spark gap G even with the guide surface 221 of the guide member 22 arranged so as to satisfy all of the dimensional relationships (1)-(4). Moreover, the direction of the flow Fc is generally oblique to a plane perpendicular the axial direction of the spark plug 1 (e.g., the second reference plane P2) by an angle less than 30°. The inventors of the present invention have found that to specify the necessary arrangement of the guide surface 221 of the guide member 22 for sufficiently coping with the flow Fc to the dimensional relationships (1)-(4), it is first necessary for the ground electrode 5 and the guide member 22 to be arranged so as to satisfy the above-described three-dimensional shape requirement. In other words, satisfying the dimensional relationships (1)-(4) upon satisfying the three-dimensional shape requirement, it is possible for the guide member 22 to reliably guide the flow Fc to the spark gap G.

Furthermore, satisfying either of the dimensional relationships (6) and (7) in addition to the dimensional relationships (1)-(5), it is possible to enhance the ignition capability of the spark plug 1. More preferably, satisfying both of the dimensional relationships (6) and (7) in addition to the dimensional relationships (1)-(5), it is possible to further enhance the ignition capability of the spark plug 1.

In the present embodiment, the guide member 22 has its distal end located at the same axial position as or proximalward from the distal end of the ground electrode 5 and at the same axial position as or distalward from the distal end of the insulator 3.

With the above configuration, it is possible to minimize the axial length of the spark plug 1 while ensuring the function of the guide member 22 to guide the flow F of the air-fuel mixture to the spark gap G. As a result, it is possible to prevent the guide member 22 from intervening with a piston in the combustion chamber of the engine while ensuring the ignition capability of the spark plug 1.

In the present embodiment, at the same axial position as the spark gap G, the circumferential width W2 of the guide member 22 is smaller than the circumferential width W1 of the standing portion 51 of the ground electrode 5.

With the above configuration, it is possible to reliably prevent the flow F of the air-fuel mixture from being blocked by the guide member 22, thereby more effectively suppressing stagnation of the flow F of the air-fuel mixture in the vicinity of the spark gap G.

In the present embodiment, the guide member 22 is configured to extend in the axial direction of the spark plug 1.

With the above configuration, it is possible to prevent stagnation of the flow F of the air-fuel mixture due to the guide member 22 from being formed in the vicinity of the spark gap G. Moreover, it is also possible to simply the shape of the guide member 22, thereby lowering the manufacturing cost of the spark plug 1.

In the present embodiment, the guide member 22 has a cross-sectional shape such that the radial width W20 of the guide member 22 is greater than the circumferential width W2 of the guide member 22.

With the above configuration, it becomes easy for the guide member 22 to effectively guide the flow F of the air-fuel mixture flowing to the vicinity of the distal part of the spark plug 1 to the spark gap G. At the same time, it becomes difficult for the guide member 22 to impede the flow F of the air-fuel mixture flowing to the vicinity of the distal part of the spark plug 1. More specifically, when the ground electrode 5 is located upstream of the spark gap G with respect to the flow F of the air-fuel mixture, the guide member 22 can perform the function of guiding the flow F of the air-fuel mixture to the spark gap G. However, when the guide member 22 itself is located upstream of the spark gap G with respect to the flow F of the air-fuel mixture, the guide member 22 may block, depending on its shape, the flow F of the air-fuel mixture toward the spark gap G. The larger the radial width W20 of the guide member 22, the easier it is for the guide member 22 to fulfill the function of guiding the flow F of the air-fuel mixture to the spark gap G. In contrast, the larger the circumferential width W2 of the guide member 22, the easier it is for the guide member 22 to impede the flow F of the air-fuel mixture toward the spark gap G. Therefore, setting the radial width W20 of the guide member 22 to be greater than the circumferential width W2 of the guide member 22, it becomes easier to 26 effectively guide the flow F of the air-fuel mixture to the spark gap G by the guide member 22 while preventing the flow F of the air-fuel mixture from being blocked by the guide member 22.

To sum up, the spark plug 1 according to the present embodiment can secure, with a simple configuration, a stable ignition capability regardless of the mounting posture of the spark plug 1 to the engine.

Comparative Example

Figure 8:
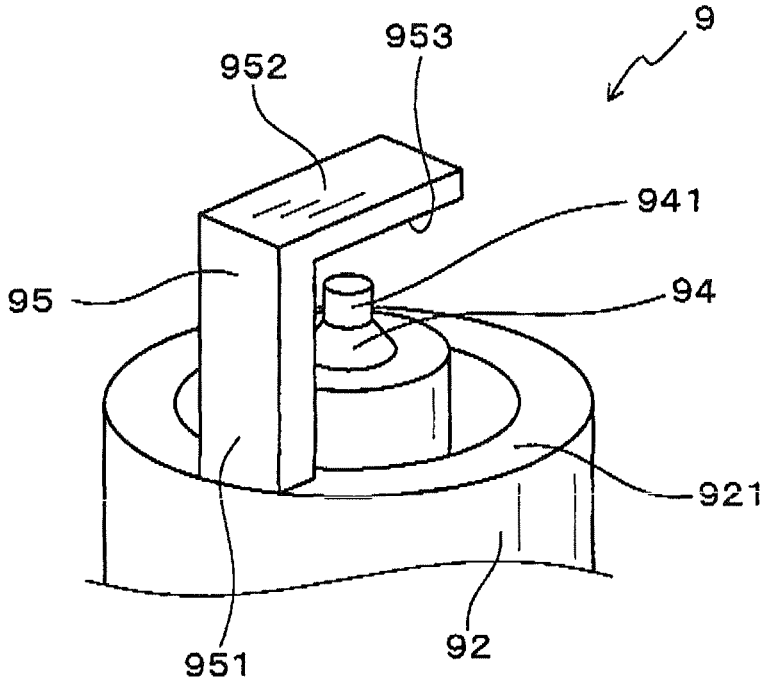
FIG. 8 is a perspective view of a distal part of a spark plug according to a comparative example.

FIG. 8 shows the overall configuration of a spark plug 9 according to a comparative example.

As shown in FIG. 8, the spark plug 9 includes a ground electrode 95, but no guide member 22 as described in the first embodiment.

The ground electrode 95 is substantially L-shaped to have a standing portion 951 and an opposing portion 952. The standing portion 951 is provided to stand (or protrude) distalward from a distal end 921 of a housing 92. The opposing portion 952 extends perpendicular to the standing portion 951 and has an opposing surface 953 that opposes a distal end portion 941 of a center electrode 94 in the axial direction of the spark plug 9 through a spark gap G formed therebetween.

When the spark plug 9 is used in an internal combustion engine, the spark discharge length N in the spark plug 9 (i.e., the length N of a spark S discharged across the spark gap G in the spark plug 9) varies depending on the mounting posture of the spark plug 9 to the engine. In addition, the spark discharge length N here denotes the length of the spark S in the direction of the flow F of an air-fuel mixture in a combustion chamber of the engine.

Figure 9A:
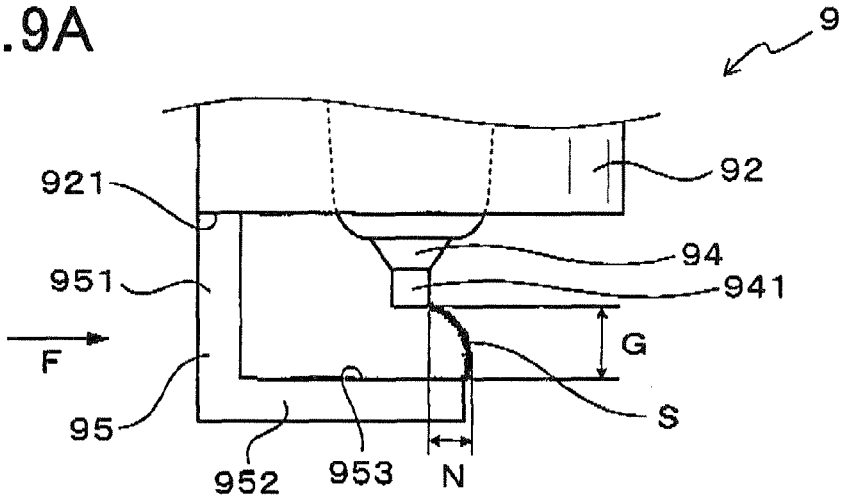
FIG. 9A is a schematic view illustrating the discharge of a spark in the spark plug according to the comparative example when the standing portion of the ground electrode is located upstream of the spark gap with respect to the flow of the air-fuel mixture.

Specifically, as shown in FIG. 9A, when the spark plug 9 is mounted to the engine so that the standing portion 951 of the ground electrode 95 is located upstream of the spark gap G with respect to the flow F of the air-fuel mixture, the spark discharge length N is very small.

Figure 9B:
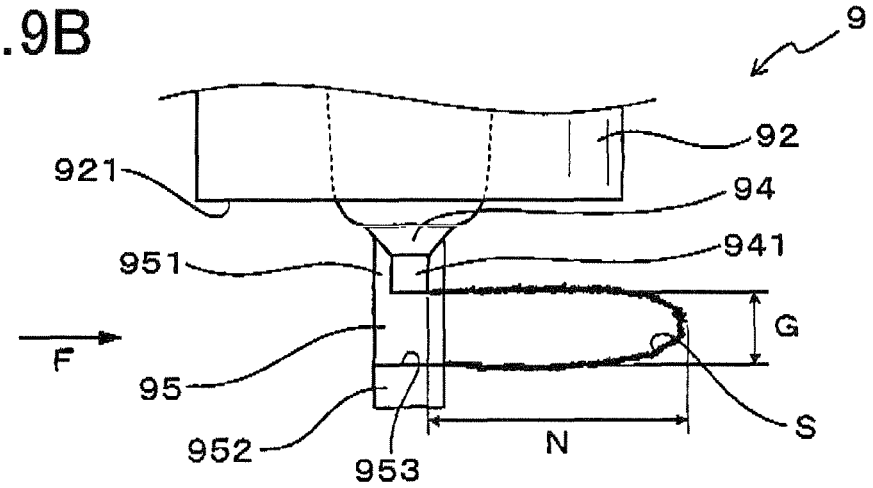
FIG. 9B is a schematic view illustrating the discharge of a spark in the spark plug according to the comparative example when the standing portion of the ground electrode is aligned with the spark gap in a direction perpendicular to the direction of the flow of the air-fuel mixture.

On the other hand, as shown in FIG. 91, when the spark plug 9 is mounted to the engine so that the standing portion 951 of the ground electrode 95 is aligned with the spark gap G in a direction perpendicular to the direction of the flow F of the air-fuel mixture (i.e., in the direction perpendicular to the paper surface of FIG. 9B), the spark discharge length N is very large.

Figure 9C:
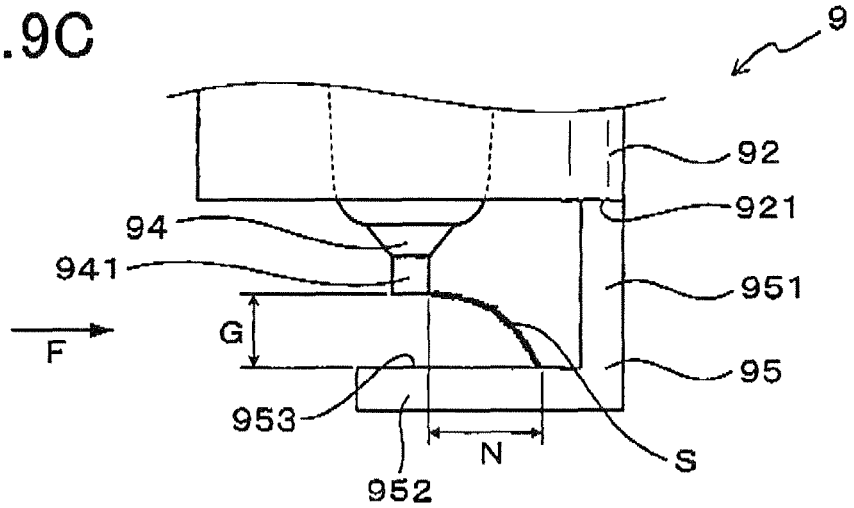
FIG. 9C is a schematic view illustrating the discharge of a spark in the spark plug according to the comparative example when the standing portion of the ground electrode is located downstream of the spark gap with respect to the flow of the air-fuel mixture.

In comparison, as shown in FIG. 9C, when the spark plug 9 is mounted to the engine so that the standing portion 951 of the ground electrode 95 is located downstream of the spark gap G with respect to the flow F of the air-fuel mixture, the spark discharge length N is moderate. That is, the spark discharge length N in this case is greater than the spark discharge length N in the case shown in FIG. 9A, but less than the spark discharge length N in the case shown in FIG. 9B.

The inventors of the present invention have found the above-described manner of variation of the spark discharge length N by measuring the spark discharge length N in each of the three cases shown in FIGS. 9A-9C with the speed of the flow F of the air-fuel mixture set to 15 m/s.

Figure 10:
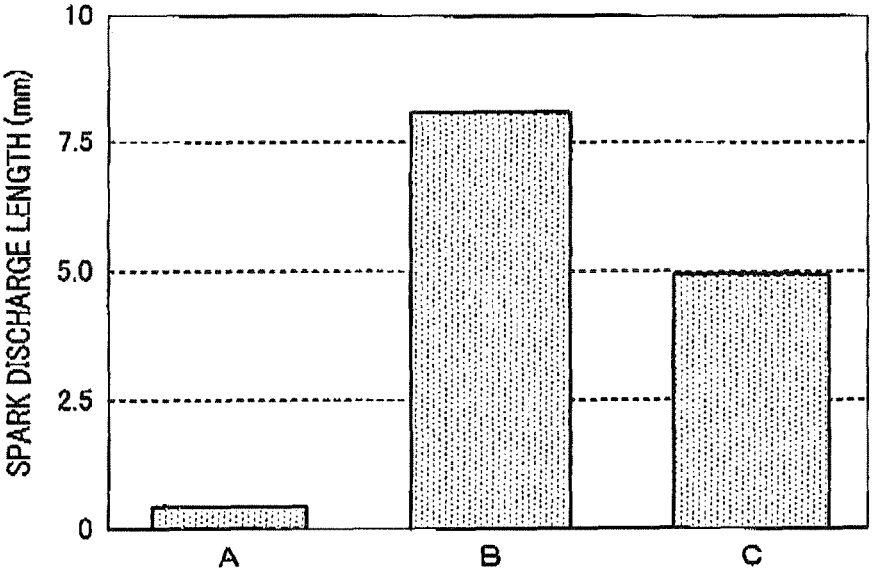
FIG. 10 is a graphical representation giving a comparison in spark discharge length between the three cases illustrated in FIGS. 9A-9C.

The measurement results are shown in FIG. 10, where A, B and C respectively designate the measured values of the spark discharge length N in the three cases shown in FIGS. 9A-9C.

The inventors of the present invention have also ascertained the relationship between the spark discharge length N and the ignition capability of the spark plug 9.

Figure 11:
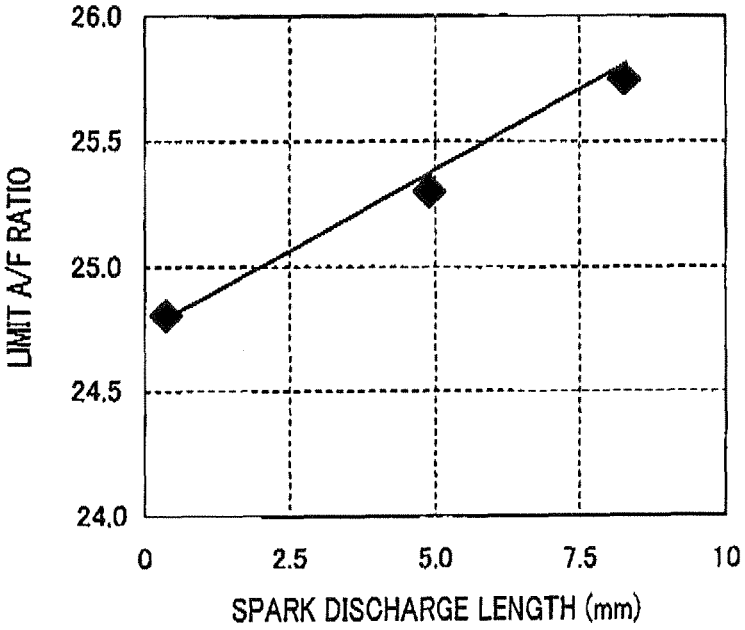
FIG. 11 is a graphical representation illustrating the relationship between the spark discharge length and the limit A/F ratio in the spark plug according to the comparative example.

More specifically, as shown in FIG. 11, it has been found that the larger the spark discharge length N, the higher the ignition capability of the spark plug 9. Here, the ignition capability of the spark plug 9 is represented by the limit A/F (Air/fuel) ratio up to which it is possible for the spark plug 9 to ignite the air-fuel mixture. In addition, the higher the limit A/F ratio (i.e., the leaner the ignitable air-fuel mixture), the higher the ignition capability of the spark plug 9.

Accordingly, from FIGS. 10-11, it has been made clear that the ignition capability of the spark plug 9 according to the comparative example varies greatly depending on the mounting posture of the spark plug 9 to the engine.

Figure 12A:
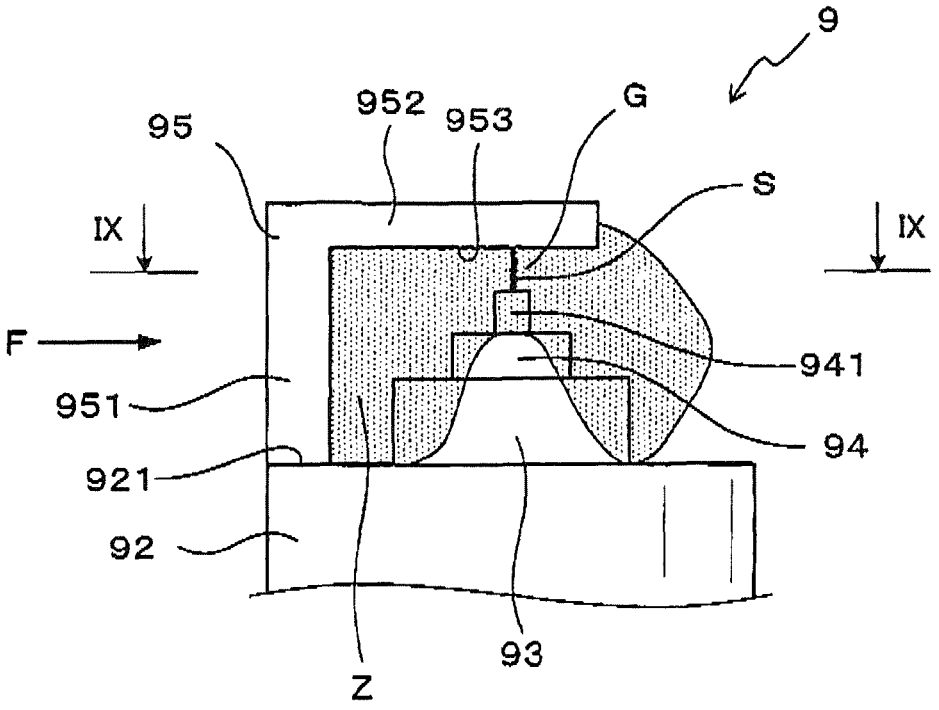
FIG. 12A is a schematic side view of the distal part of the spark plug according to the comparative example illustrating stagnation of the flow of the air-fuel mixture when the standing portion of the ground electrode is located upstream of the spark gap with respect to the flow of the air-fuel mixture.
Figure 12B:
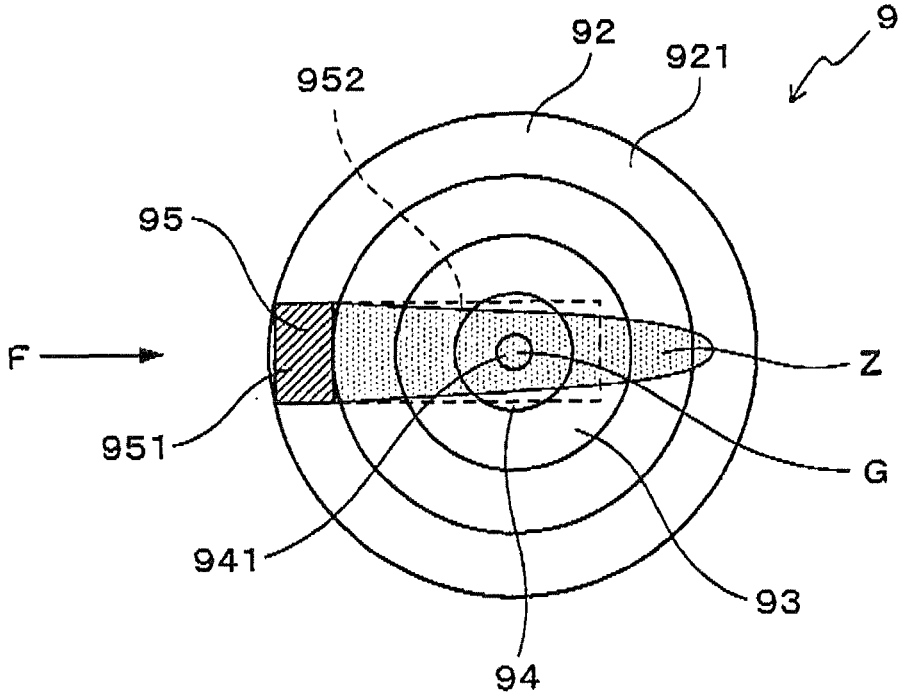
FIG. 12B is a schematic cross-sectional view taken along the line IX-IX in FIG. 12A.
Figure 13:
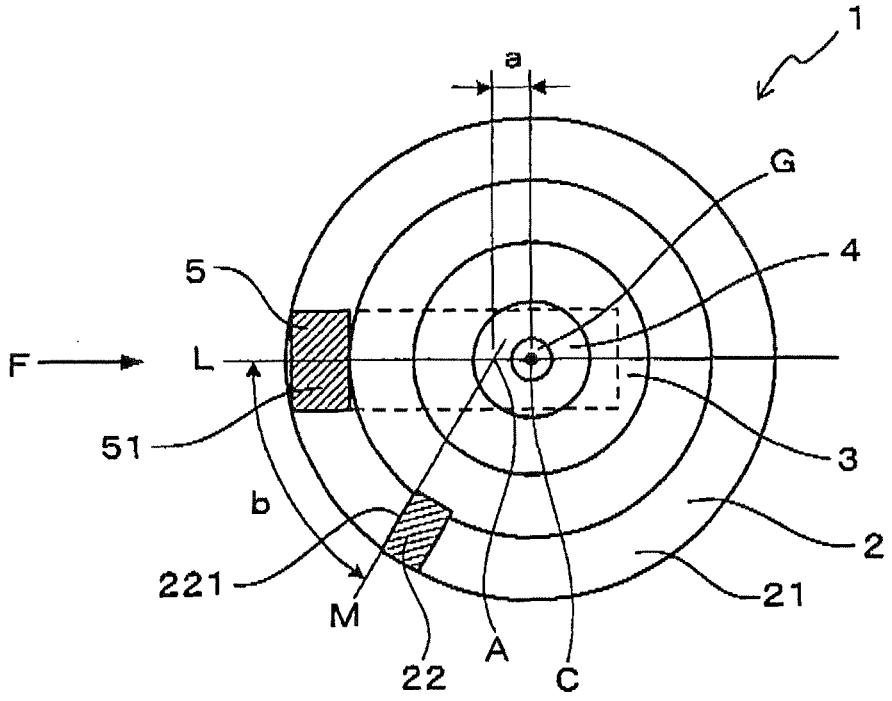
FIG. 13 is a cross-sectional view of a distal part of a sample spark plug tested in an experiment.
Figure 14:
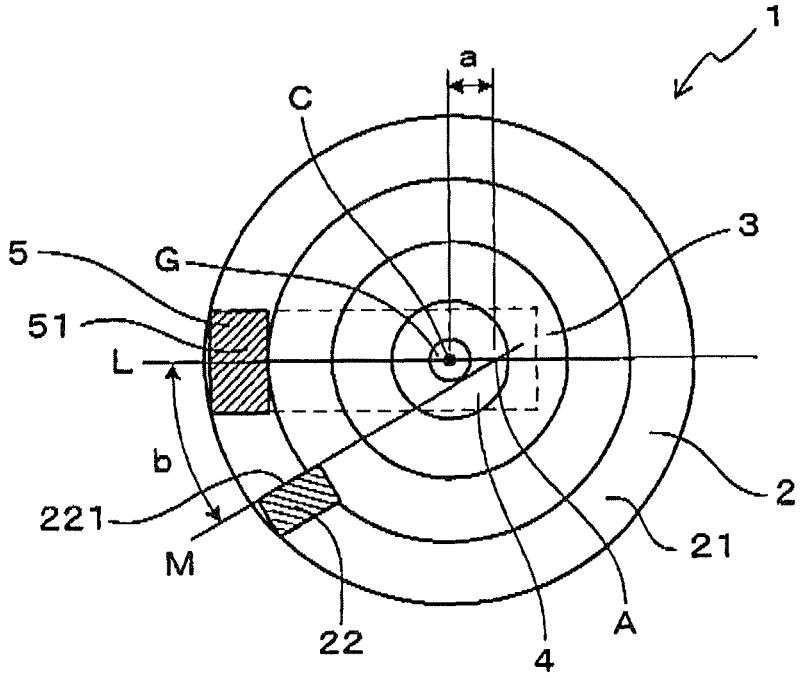
FIG. 14 is a cross-sectional view of a distal part of another sample spark plug tested in the experiment.

In addition, as shown in FIGS. 12A-12B, when the standing portion 951 of the ground electrode 95 is located upstream of the spark gap G, the flow F of the air-fuel mixture is blocked by the entire standing portion 951, causing stagnation of the flow F of the air-fuel mixture to occur behind the entire standing portion 951. More specifically, stagnation of the flow F of the air-fuel mixture occurs in the region designated by Z in FIGS. 12A-12B. Most or the whole of the spark gap G is included in the region Z; thus, it is difficult for the spark S discharged across the spark gap G to extend in the direction of the flow F of the air-fuel mixture. Consequently, the spark discharge length N is very small as shown in FIG. 9A, making it difficult to secure a stable ignition capability of the spark plug 9.

Experiment

This experiment has been conducted to investigate the effects of the parameters a and b on the ignition capability of the spark plug 1 according to the first embodiment.

Specifically, in the experiment, a plurality of sample spark plugs were prepared each of which had the same basic configuration as the spark plug 1 according to the first embodiment. In particular, each of the sample spark plugs was configured to satisfy the three-dimensional shape requirement described in the first embodiment. However, the parameters a and b were varied for those sample spark plugs. For example, two of those sample spark plugs are respectively shown in FIGS. 13 and 14.

In the experiment, each of the sample spark plugs was tested in the following way. First, the sample spark plug was arranged in a combustion chamber so that the standing portion 51 of the ground electrode 5 of the sample spark plug was located upstream of the spark gap G with respect to the flow F of the air-fuel mixture in the combustion chamber. That is, the sample spark plug was arranged in the combustion chamber in the same manner as shown in FIGS. 3-4 so that the straight line L drawn in the sample spark plug was parallel to the direction of the flow F of the air-fuel mixture in the combustion chamber. The speed of the flow F of the air-fuel mixture on the upstream side of the sample spark gap was set to 20 m/s. Then, the speed of the flow F of the air-fuel mixture in the spark gap G of the sample spark plug was measured. More specifically, the speed of the flow F of the air-fuel mixture was measured at twelve points which were in the spark gap G and on the central axis Y of the center electrode 4; the highest one of the twelve measured values was recorded to represent the speed of the flow F of the air-fuel mixture in the spark gap G.

In addition, the lower the speed of the flow F of the air-fuel mixture in the spark gap G, the smaller the spark discharge length N. Further, as ascertained in the above-described comparative example, the smaller the spark discharge length N, the lower the ignition capability of the sample spark plug (see FIG. 11). Therefore, the ignition capability of the sample spark plug could be indirectly evaluated by measuring the speed of the flow F of the air-fuel mixture in the spark gap G of the sample spark plug.

Figure 15:
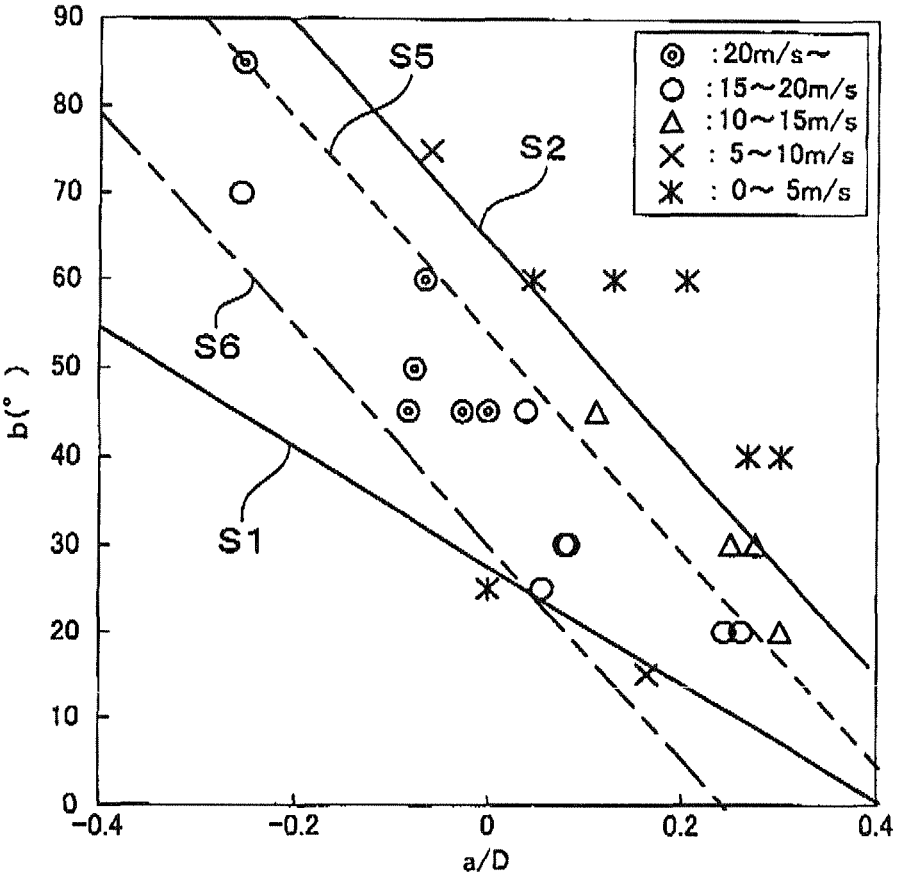
FIG. 15 is a graphical representation showing the test results of the experiment.

The evaluation results of all the sample spark plugs are shown in FIG. 15, where the horizontal axis indicates the ratio (a/D) of the distance a to the outer diameter D of the housing 2 and the vertical axis indicates the angle b in degrees (°). Moreover, in FIG. 15, the symbols ◎ designate those sample spark plugs where the speed of the flow F of the air-fuel mixture in the spark park gap G was higher than or equal to 20 m/s; the symbols ○ designate those sample spark plugs where the speed of the flow F of the air-fuel mixture in the spark park gap G was lower than 20 m/s and higher than or equal to 15 m/s; the symbols Δ designate those sample spark plugs where the speed of the flow F of the air-fuel mixture in the spark park gap G was lower than 15 m/s and higher than or equal to 10 m/s; the symbols x designate those sample spark plugs where the speed of the flow F of the air-fuel mixture in the spark park gap G was lower than 10 m/s and higher than or equal to 5 m/s; and the symbols * designate those sample spark plugs where the speed of the flow F of the air-fuel mixture in the spark park gap G was lower than 5 m/s.

Furthermore, in FIG. 15, the straight line S1 represents the equation "b=−67.8×(a/D)+27.4", which differs from the above-described dimensional relationship (1) only in that the sign "=" is included in the equation whereas the sign "≥" is included in the dimensional relationship (1). The straight line S2 represents the equation "b=−123.7×(a/D)+64.5", which differs from the above-described dimensional relationship (2) only in that the sign "=" is included in the equation whereas the sign "≤" is included in the dimensional relationship (2). The straight line S5 represents the equation "b=−123.4×(a/D)+53.7", which differs from the above-described dimensional relationship (6) only in that the sign "=" is included in the equation whereas the sign "≤" is included in the dimensional relationship (6). The straight line S6 represents the equation "b=−123.1×(a/D)+30.0", which differs from the above-described dimensional relationship (7) only in that the sign "=" is included in the equation whereas the sign "≥" is included in the dimensional relationship (7). In addition, the entire coordinate plane of FIG. 15 represents a range satisfying both the above-described dimensional relationships (3) and (4).

Moreover, in FIG. 15, on the region between the straight lines S1 and S2, there are only the symbols ◎, ○ and Δ (i.e., no x or *). In contrast, on the regions other than the region between the straight lines S1 and S2, there are only the symbols x and * (i.e., no ◎, ○ or Δ). That is, on the region between the straight lines S1 and S2, it was possible to secure the speed of the flow F of the air-fuel mixture in the spark gap G higher than or equal to 10 m/s (i.e., 50% of the speed of the flow F on the upstream side of the sample spark plug which was set to 20 m/s).

Accordingly, from the above evaluation results, it has been made clear that satisfying the above-described dimensional relationships (1)-(4), it is possible to secure a sufficiently high speed of the flow F of the air-fuel mixture in the spark gap G, thereby ensuring the ignition capability of the spark plug 1 regardless of the mounting posture of the spark plug 1 to the engine.

Moreover, of the region between the straight lines S1 and S2 in FIG. 15, the sub-region between the straight lines S5 and S6 has only the symbols ◎ and ○ (i.e., no Δ) concentrated thereon. That is, on the sub-region, it was possible to secure the speed of the flow F of the air-fuel mixture in the spark gap G higher than or equal to 15 m/s (i.e., 75% of the speed of the flow F on the upstream side of the sample spark plug which was set to 20 m/s).

Accordingly, it also has been made clear that satisfying at least one of the above-described dimensional relationships (6) and (7) in addition to the dimensional relationships (1)-(4), it is possible to increase the speed of the flow F of the air-fuel mixture in the spark gap Q thereby enhancing the ignition capability of the spark plug 1

Furthermore, in FIG. 15, on the region between the straight lines S1 and S2, the symbols ◎ and ○ are concentrated in the range of (a/D) between −0.3 and 0.3.

Accordingly, it also has been made clear that satisfying the 6 above-described dimensional relationship (8) in addition to the dimensional relationships (1)-(4), it is possible to more reliably secure a sufficiently high speed of the flow F of the air-fuel mixture in the spark gap G, thereby more reliably ensuring the ignition capability of the spark plug 1 regardless of the mounting posture of the spark plug 1 to the engine.

Second Embodiment

In the first embodiment, the ground electrode 5 is constituted of the standing portion 51 and the opposing portions 52 that extend perpendicular to each other (see FIG. 1).

Figure 16:
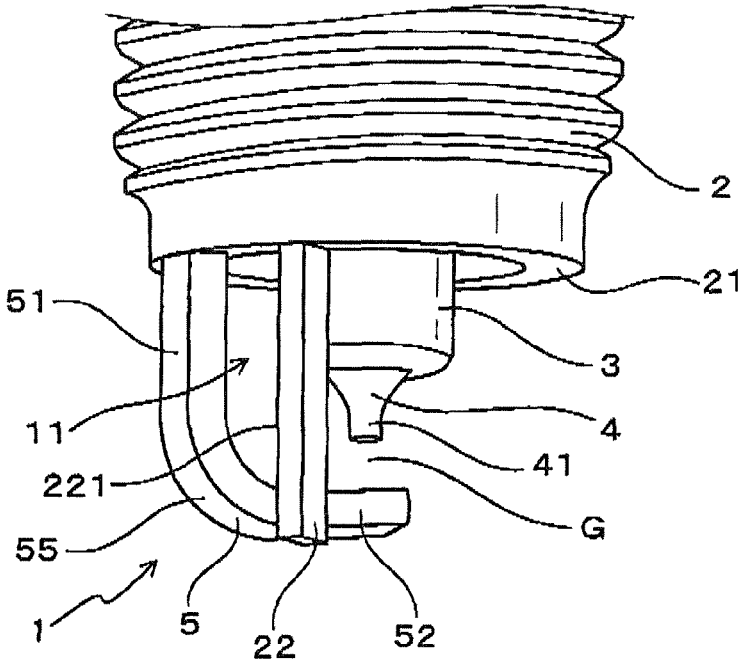
FIG. 16 is a perspective view of a distal part of a spark plug according to a second embodiment.

In comparison, in the present embodiment, as shown in FIG. 16, the ground electrode 5 further has a bent portion 55 between the standing portion 51 and the opposing portion 52. The bent portion 55 is bent into a substantially arc shape.

In the present embodiment, the spark plug 1 also satisfies the three-dimensional shape requirement as in the first embodiment.

Figure 17:
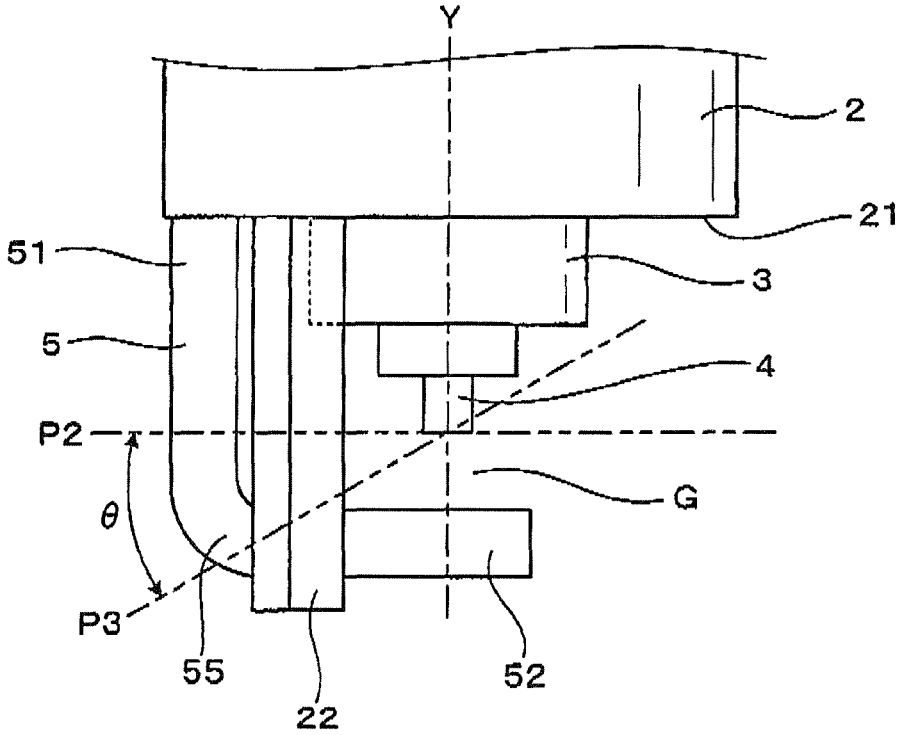
FIG. 17 is a schematic side view of the distal part of the spark plug according to the second embodiment illustrating the three-dimensional shape requirement for the spark plug.
Figure 18:
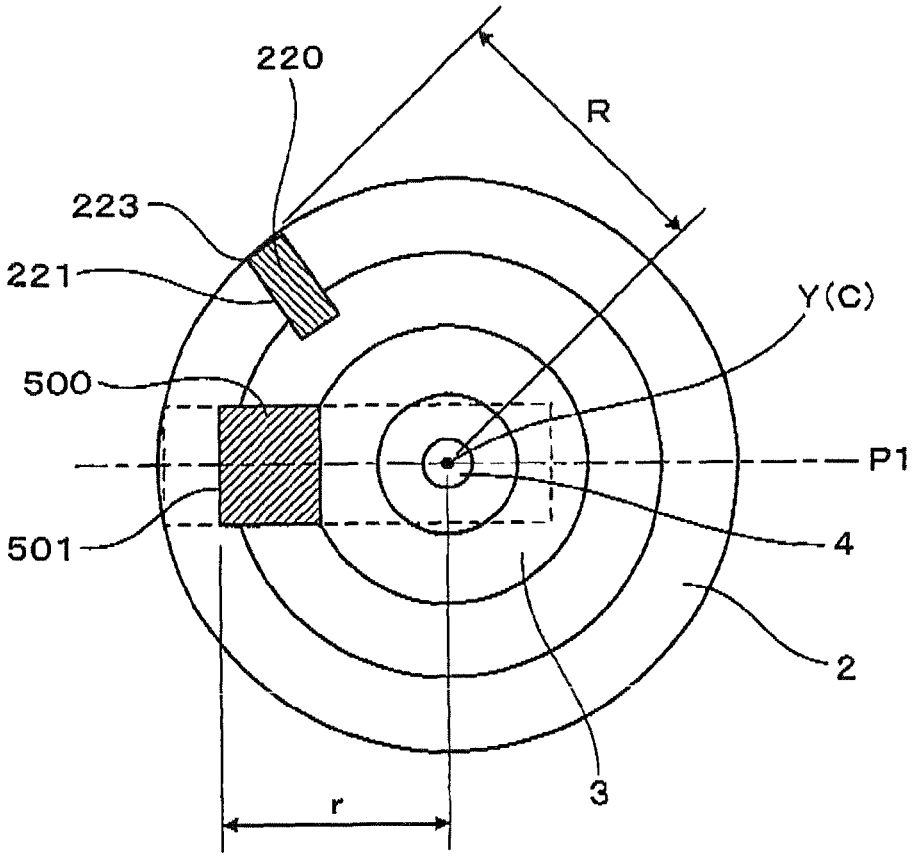
FIG. 18 is a schematic cross-sectional view of the distal part of the spark plug according to the second embodiment illustrating the three-dimensional shape requirement for the spark plug.

Specifically, in the present embodiment, as shown in FIG. 17, the ground electrode 5 has the cross section 500 taken along the third reference plane P3. The guide member 22 has the cross section 220 taken along the third reference plane P3. The oblique angle θ of the third reference plane P3 with respect to the second reference plane P2 is approximately equal to 30°. Moreover, as shown in FIG. 18, the cross section 550 of the ground electrode 5 and the cross section 220 of the guide member 22 are projected on the projection plane (i.e., the paper surface of FIG. 18) that is defined to extend perpendicular to the axial direction of the spark plug 1 through the spark gap G.

In the present embodiment, there is formed in the ground electrode 5 the bent portion 55 between the standing portion 51 and the opposing portion 52. Therefore, when the oblique angle θ is close to 30°, the cross section 500 of the ground electrode 5 may be made to pass through the bent portion 55. Consequently, depending on the formation of the bent portion 55, the distance r (see FIG. 18) on the projection plane may become too small to satisfy the dimensional relationship (5), i.e., $0.8 \leq r/R \leq 1$.

In consideration of the above, in the present embodiment, the ground electrode 5 is shaped so as to satisfy the dimensional relationship (5) even with the bent portion 55 formed therein. Moreover, upon satisfying the dimensional relationship (5), the spark plug 1 further satisfies all of the dimensional relationships (1)-(4) as in the first embodiment.

Next, a method of manufacturing the spark plug 1 according to the present embodiment will be described. This method includes first to sixth steps.

Figure 19:
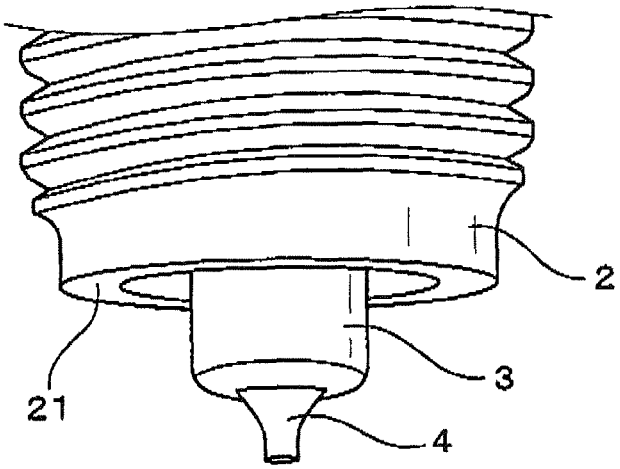
FIG. 19 is a schematic view illustrating the first step of a method of manufacturing the spark plug according to the second embodiment.

In the first step, as shown in FIG. 19, the housing 2 is prepared which has both the insulator 3 and the center electrode 4 assembled therein.

Figure 20:
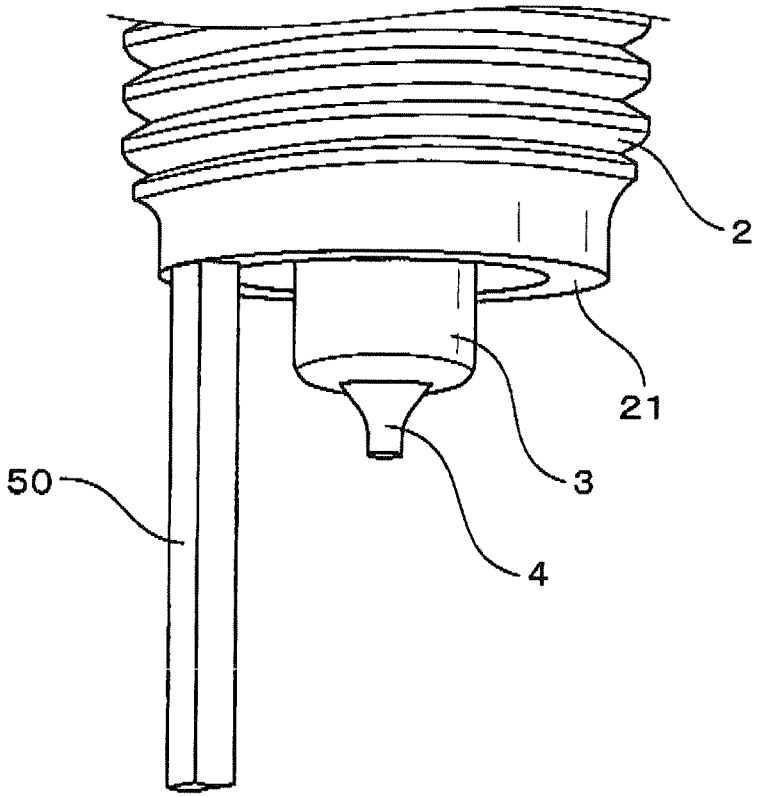
FIG. 20 is a schematic view illustrating the second step of the method of manufacturing the spark plug according to the second embodiment.

In the second step, as shown in FIG. 20, a quadrangular prism-shaped electrode material 50 for forming the ground electrode 5 is welded, for example by resistance welding, to the distal end 21 of the housing 2.

Figure 21:
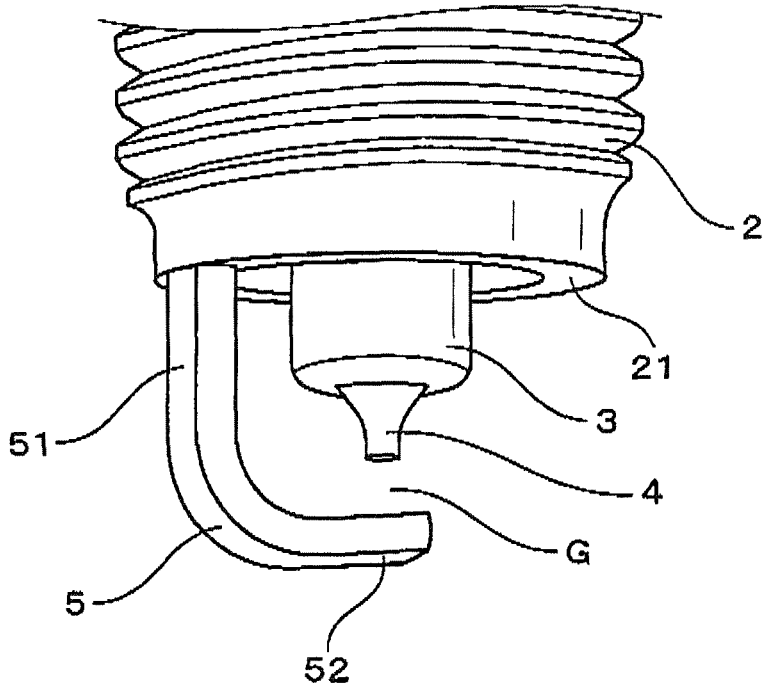
FIG. 21 is a schematic view illustrating the third step of the method of manufacturing the spark plug according to the second embodiment.

In the third step, as shown in FIG. 21, the electrode material 50 is bent to form the substantially L-shaped ground electrode 5. Consequently, the spark gap G is formed between the center electrode 4 and the opposing portion 52 of the ground electrode 5.

Figure 22:
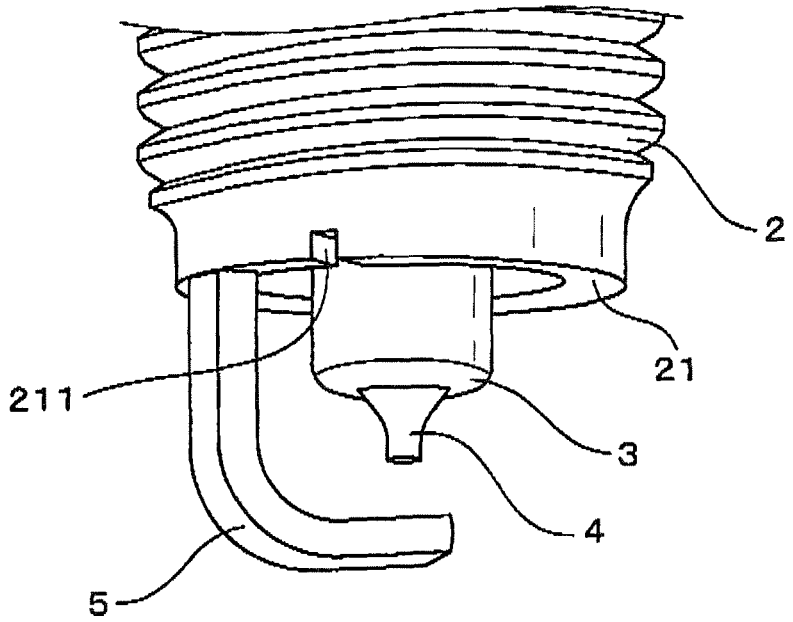
FIG. 22 is a schematic view illustrating the fourth step of the method of manufacturing the spark plug according to the second embodiment.

In the fourth step, as shown in FIG. 22, at a predetermined position on the distal end 21 of the housing 2, a groove 211 is formed so as to penetrate the housing 2 in a radial direction of the spark plug 1. In addition, the position of formation of the groove 211 is predetermined based on the positional relationship between the center electrode 4, the ground electrode 5 and the guide member 22 to be fitted in the groove 211.

Figure 23:
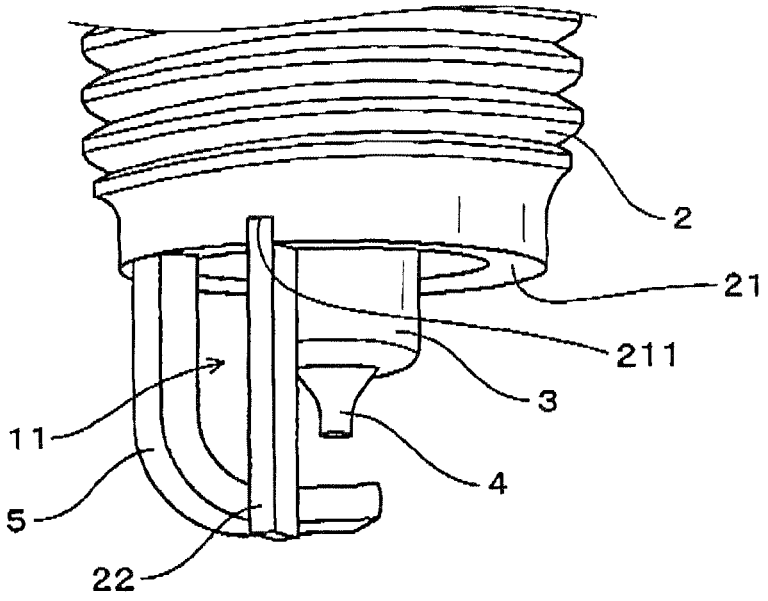
FIG. 23 is a schematic view illustrating the fifth step of the method of manufacturing the spark plug according to the second embodiment.

In the fifth step, as shown in FIG. 23, a proximal end portion of the guide member 22 is fitted in the groove 211.

Figure 24:
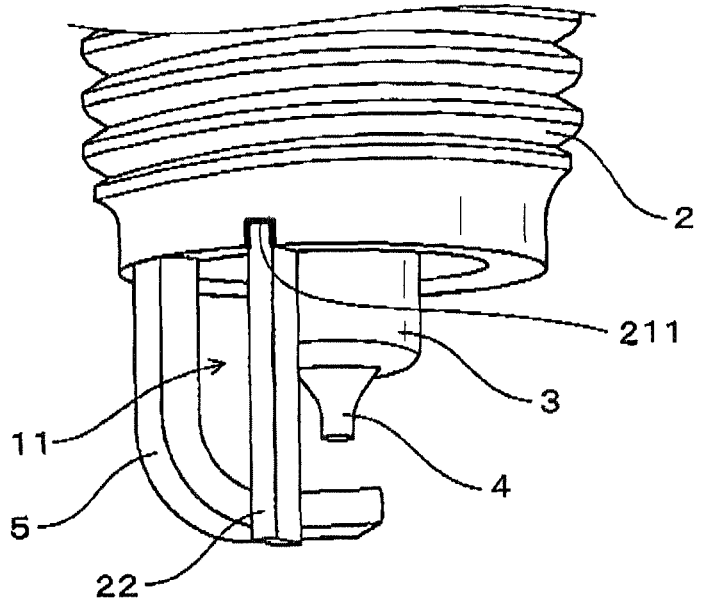
FIG. 24 is a schematic view illustrating the sixth step of the method of manufacturing the spark plug according to the second embodiment.

In the sixth step, as shown in FIG. 24, the proximal end portion of the guide member 22 is welded, for example by resistance welding, to peripheral portions of the groove 211 in the housing 2.

It should be noted that laser welding may be used instead of resistance welding in the above second and sixth steps of the method.

According to the present embodiment, it is also possible to achieve the same advantageous effects as described in the first embodiment.

Third Embodiment

Figure 25:
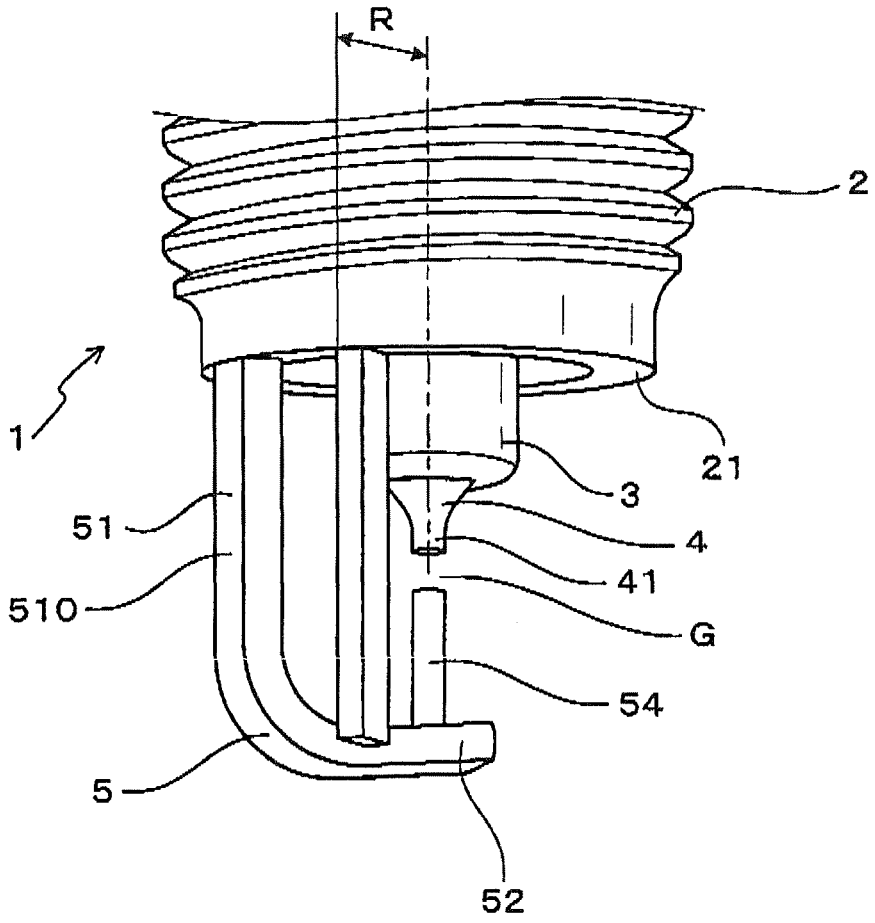
FIG. 25 is a perspective view of a distal part of a spark plug according to a third embodiment.

In this embodiment, as shown in FIG. 25, the standing portion 51 of the ground electrode 5 includes an elongated axially-extending part 510 that extends from the distal and 21 of the housing 2 in the axial direction of the spark plug 1.

Figure 26:
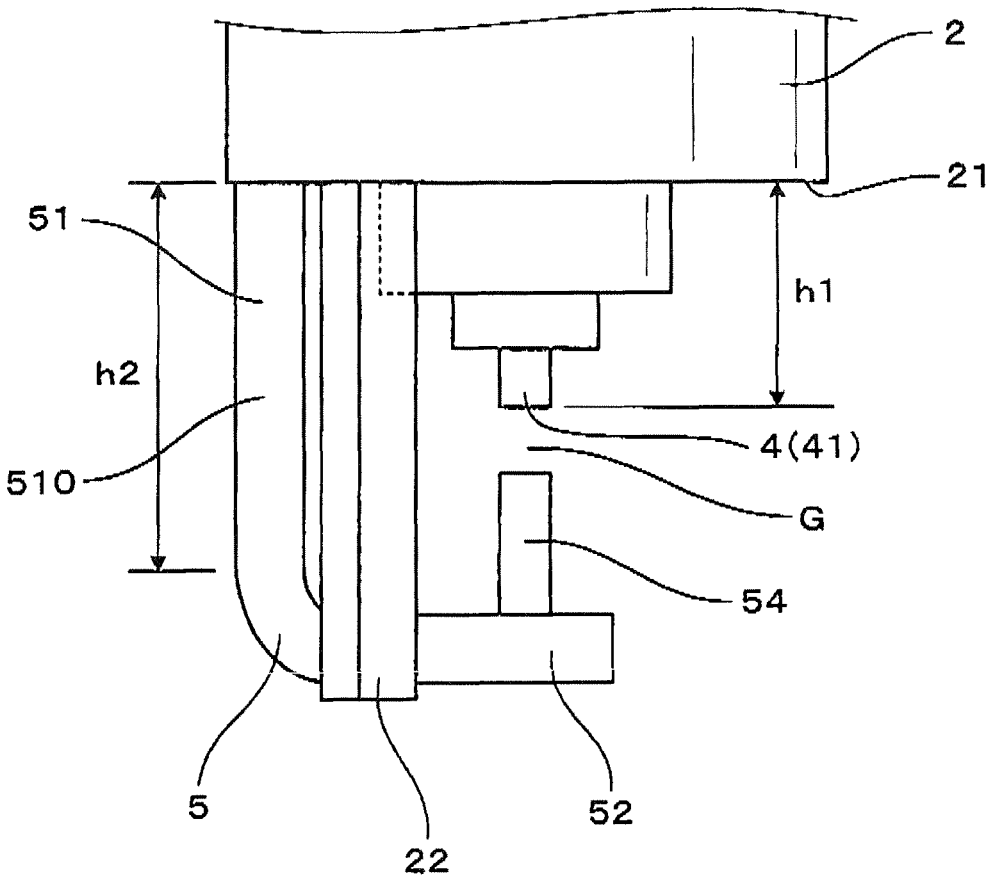
FIG. 26 is a side view of the distal part of the spark plug according to the third embodiment.

Specifically, in the present embodiment, as shown in FIG. 26, the spark plug 1 is configured to further satisfy the following dimensional relationship:

$$h2 \geq h1 + R \times \tan 30° \quad (9)$$

where h1 is the axial distance from the distal end 21 of the housing 2 to the distal end of the distal end portion 41 of the center electrode 4, h2 is the axial length of the axially-extending part 510 of the standing portion 51 of the ground electrode 5, and R is the distance as defined in the first embodiment (see FIGS. 6 and 25).

In addition, in the present embodiment, the guide member 22 extends in the axial direction of the spark plug 1. Therefore, even if the oblique angle θ changes in the range of 0 to 30°, the distance R is kept constant.

Moreover, in the present embodiment, the ground electrode 5 further has a protrusion 54 that is formed on the opposing surface 53 of the opposing portion 52 so as to face the distal end portion 41 of the center electrode 4 through the spark gap G formed therebetween. Consequently, though the standing portion 51 includes the elongated axially-extending part 510, it is still possible to maintain a suitable size of the spark gap G.

According to the present embodiment, it is also possible to achieve the same advantageous effects as described in the first embodiment.

Moreover, in the present embodiment, the spark plug 1 further satisfies the above dimensional relationship (9). Therefore, even if the oblique angle θ changes in the range of 0 to 30°, the position and shape of the projection of the cross section 500 of the ground electrode 5 on the projection plane remain unchanged (see FIG. 6). Thus, the distance r also remains unchanged. Consequently, with both r and R remaining unchanged, the ratio r/R in the above-described dimensional relationship (5) is kept constant. As a result, it is possible to more reliably satisfy the three-dimensional shape requirement, thereby more reliably securing a stable ignition capability of the spark plug 1 regardless of the mounting posture of the spark plug 1 to the engine.

Fourth Embodiment

This embodiment is a modification of the third embodiment

Figure 27:
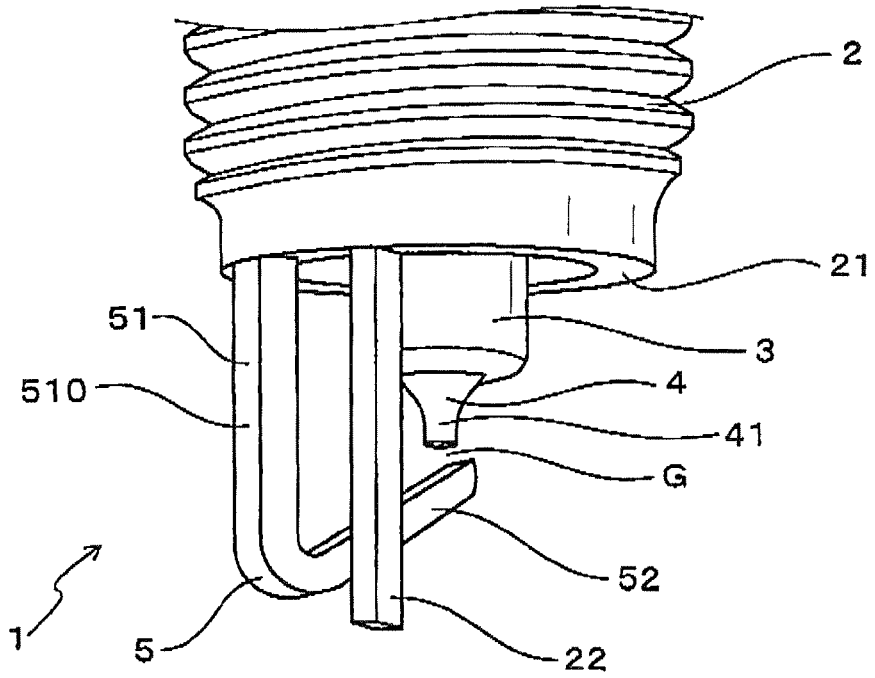
FIG. 27 is a perspective view of a distal part of a spark plug according to a fourth embodiment.

Specifically, in the present embodiment, as shown in FIG. 27, the standing portion 51 of the ground electrode 5 includes the elongated axially-extending part 510 as in the third embodiment.

However, in the present embodiment, the ground electrode 5 has no protrusion 54 described in the third embodiment. Instead, the opposing portion 52 of the ground electrode 5 extends obliquely with respect to the standing portion 51 so that the axial distance between the opposing portion 52 and the distal end portion 41 of the center electrode 4 decreases in the radially inward direction. Consequently, though the standing portion 51 of the ground electrode 5 includes the elongated axially-extending part 510 and there is no protrusion 54 formed in the ground electrode 5, it is still possible to maintain a suitable size of the spark gap G.

According to the present embodiment, it is possible to achieve the same advantageous effects as achievable according to the third embodiment.

Fifth Embodiment

This embodiment is another modification of the third embodiment.

Figure 28:
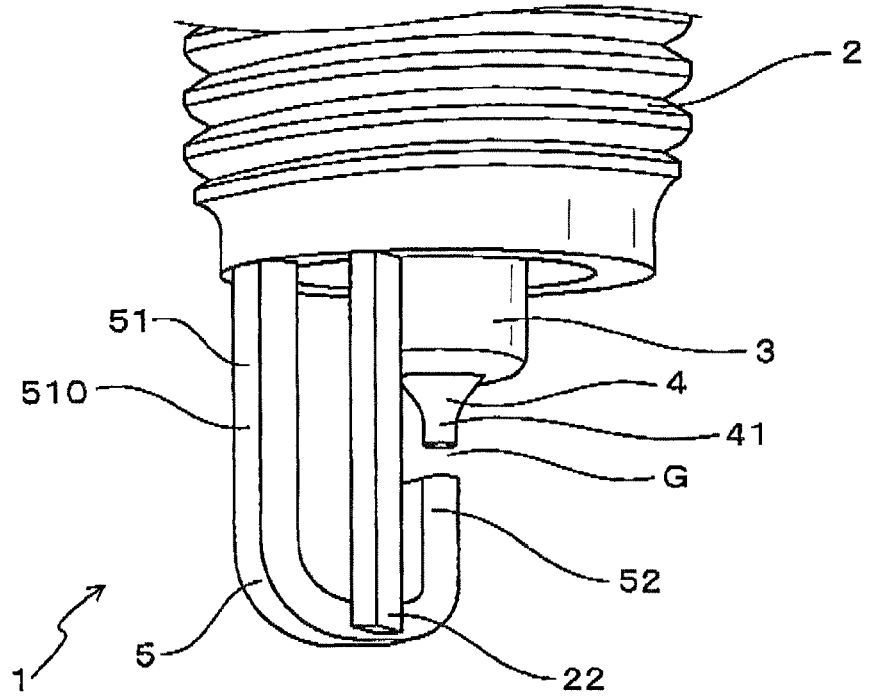
FIG. 28 is a perspective view of a distal part of a spark plug according to a fifth embodiment.

Specifically, in the present embodiment, as shown in FIG. 28, the standing portion 51 of the ground electrode 5 includes the elongated axially-extending part 510 as in the third embodiment.

However, in the present embodiment, the ground electrode 5 has no protrusion 54 described in the third embodiment. Instead, the ground electrode 5 is substantially U-shaped. That is, the opposing portion 52 of the ground electrode 5 is bent to have first and second parts. The first part extends radially inward from the standing portion 51 of the ground electrode 5. The second part extends proximalward from the first part. The second part faces the distal end portion 41 of the center electrode 4 in the axial direction of the spark plug 1 through the spark gap G formed therebetween. Consequently, though the standing portion 51 of the ground electrode 5 includes the elongated axially-extending part 510 and there is no protrusion 54 formed in the ground electrode 5, it is still possible to maintain a suitable size of the spark gap G.

According to the present embodiment, it is possible to achieve the same advantageous effects as achievable according to the third embodiment.

Sixth Embodiment

Figure 29:
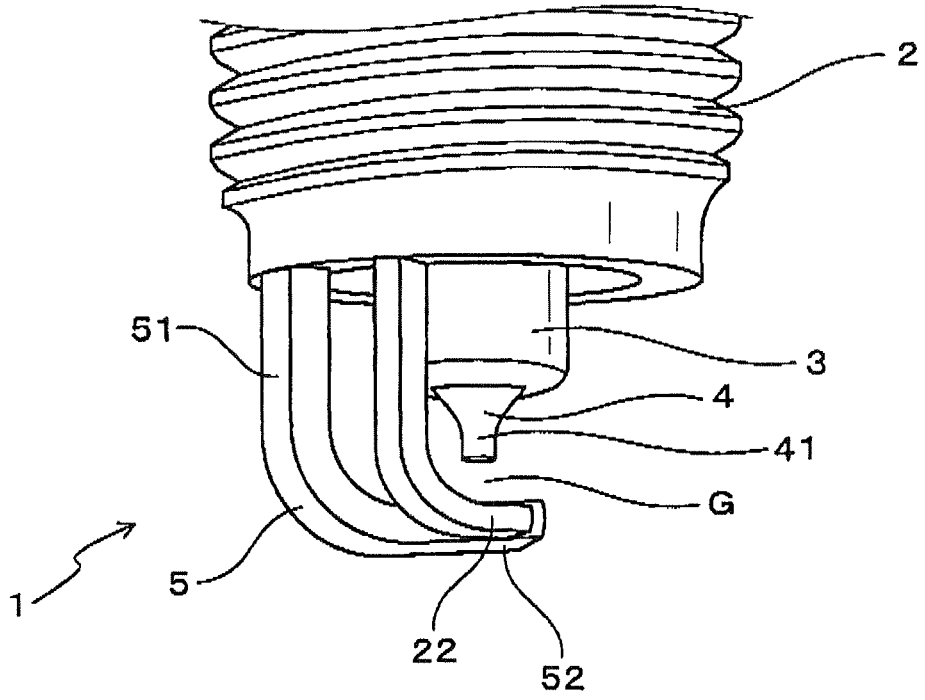
FIG. 29 is a perspective view of a distal part of a spark plug according to a sixth embodiment.

In this embodiment, as shown in FIG. 29, the guide member 22 is also bent into a substantially L-shape as the ground electrode 5.

Specifically, in the present embodiment, the guide member 22 is bent at substantially the same axial position as the spark gap G to have first and second parts. The first part extends distalward from the distal end 21 of the housing 2. The second part extends radially inward from the first part. In addition, the guide member 22 is bent so as to overlap the ground electrode 5 in the circumferential direction of the spark plug 1.

According to the present embodiment, it is also possible to achieve the same advantageous effects as described in the first embodiment.

Moreover, in the present embodiment, with the bent guide member 22, the ratio r/R in the above-described dimensional relationship (5) hardly changes as the oblique angle θ changes in the range of 0 to 30°. As a result, it becomes easier to satisfy the three-dimensional shape requirement.

Seventh Embodiment

Figure 30:
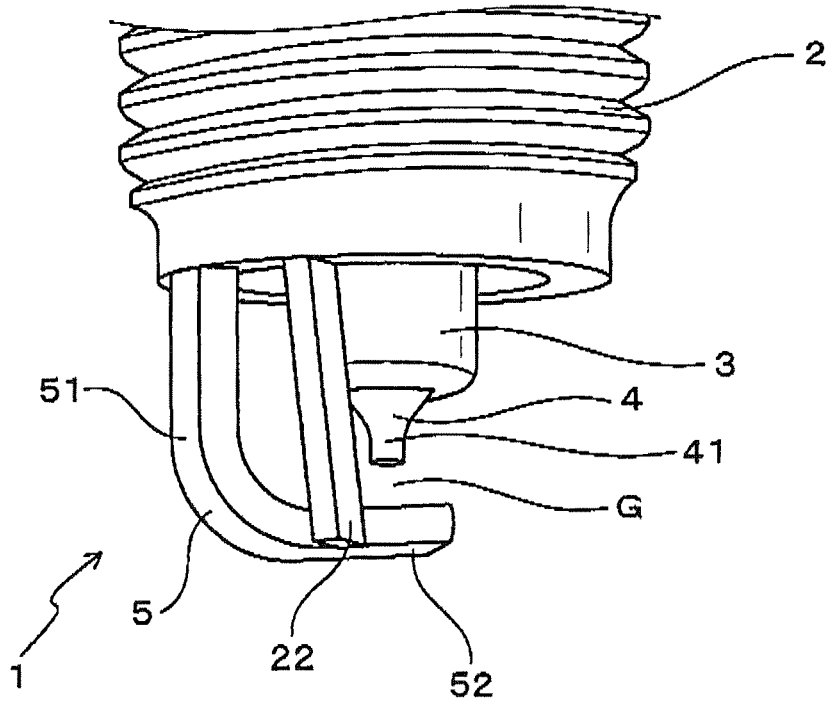
FIG. 30 is a perspective view of a distal part of a spark plug according to a seventh embodiment.

In this embodiment, as shown in FIG. 30, the guide member 22 extends from the distal end 21 of the housing 2 obliquely with respect to the axial direction of the spark plug 1.

Specifically, in the present embodiment, the guide member 22 extends obliquely with respect to the axial direction of the spark plug 1 so that the distance between the guide member 22 and the central axis Y of the center electrode 4 decreases in the distalward direction.

In addition, in the present embodiment, the guide member 22 extends obliquely with respect to the axial direction of the spark plug 1 over the entire length of the guide member 22. However, it should be noted that the guide member 22 may extend obliquely with respect to the axial direction of the spark plug 1 for only part of the length of the guide member 22.

According to the present embodiment, it is also possible to achieve the same advantageous effects as described in the first embodiment.

Moreover, in the present embodiment, with the oblique guide member 22, the ratio r/R in the above-described dimensional relationship (5) hardly changes as the oblique angle θ changes in the range of 0 to 30°. As a result, it becomes easier to satisfy the three-dimensional shape requirement.

Eighth Embodiment

Figure 31:
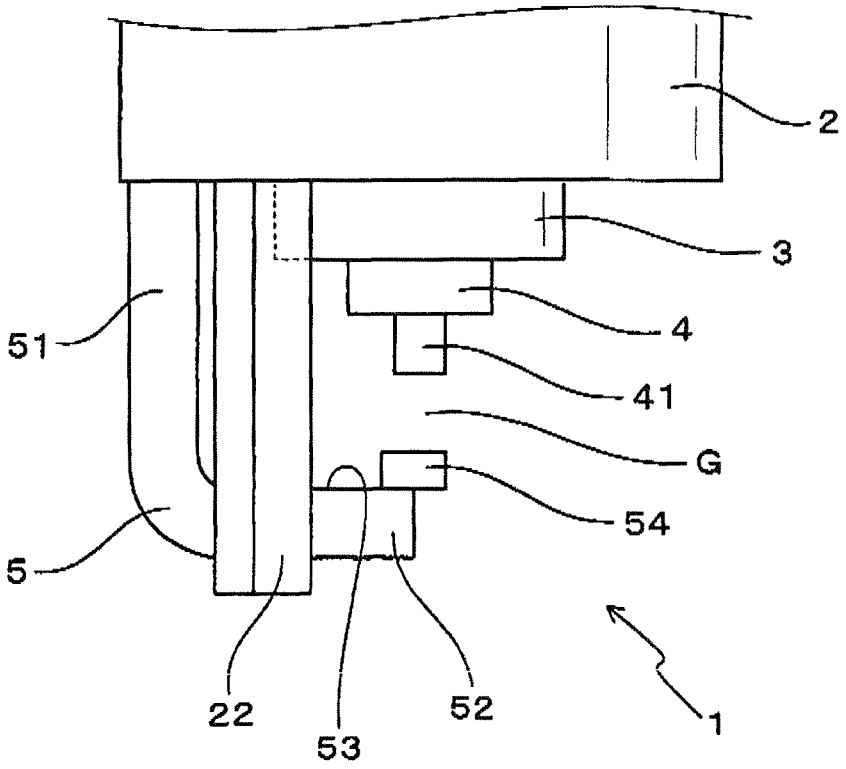
FIG. 31 is a side view of a distal part of a spark plug according to an eighth embodiment.

In this embodiment, as shown in FIG. 31, the ground electrode 5 has a protrusion 54 that is formed on the opposing surface 53 of the opposing portion 52 so as to face the distal end portion 41 of the center electrode 4 through the spark gap G formed therebetween.

Moreover, part of the protrusion 54 protrudes radially inward (or toward the opposite side to the standing portion 51) from the opposing portion 52. That is, part of the protrusion 54 is not located on the opposing surface 53 of the opposing portion 52.

In the present embodiment, the protrusion 54 is formed by, for example, welding a noble metal chip to the opposing surface 53 of the opposing portion 52.

According to the present embodiment, it is also possible to achieve the same advantageous effects as described in the first embodiment.

Ninth Embodiment

Figure 32:
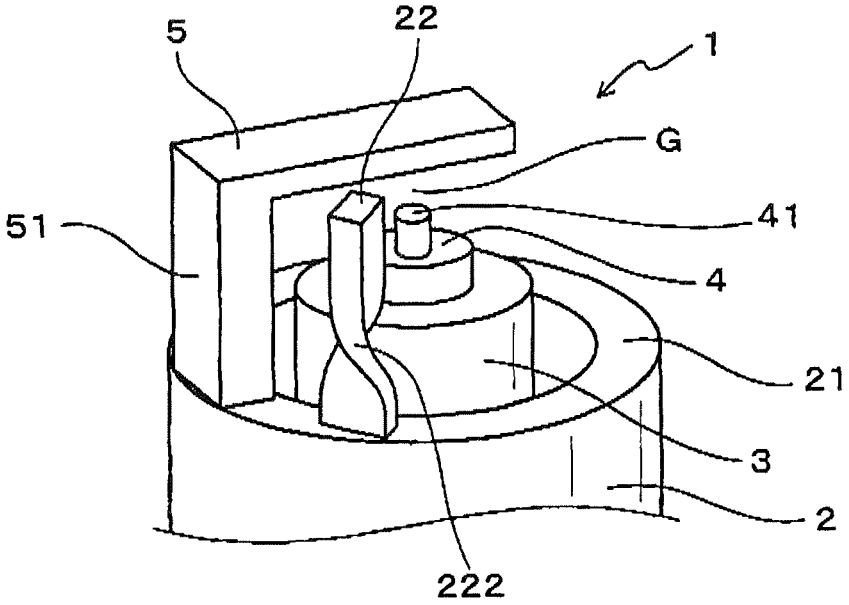
FIG. 32 is a perspective view of a distal part of a spark plug according to a ninth embodiment.
Figure 33:
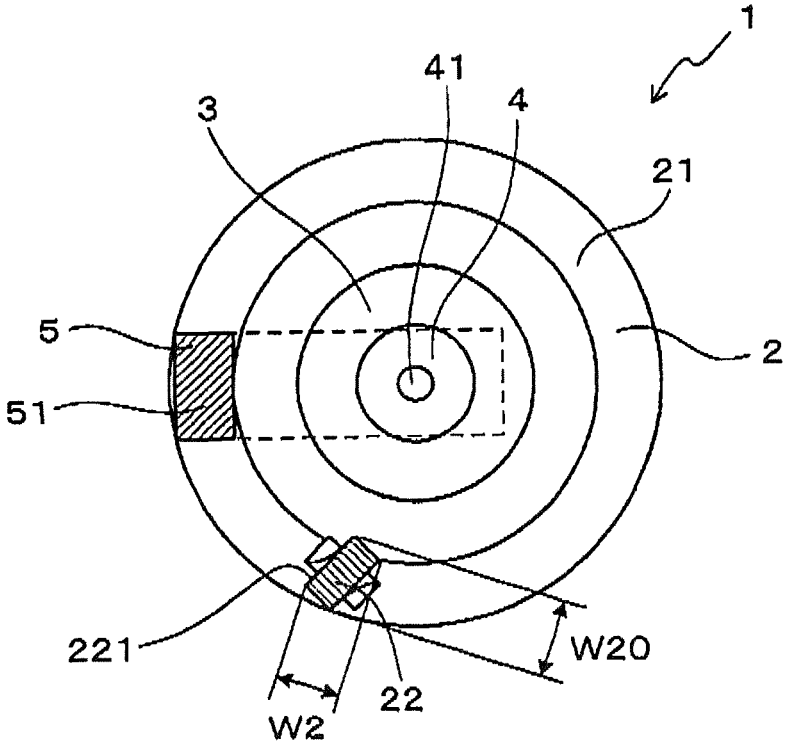
FIG. 33 is a cross-sectional view of the spark plug according to the ninth embodiment taken along a plane that extends perpendicular to an axial direction of the spark plug through a spark gap formed in the spark plug.
Figure 34:
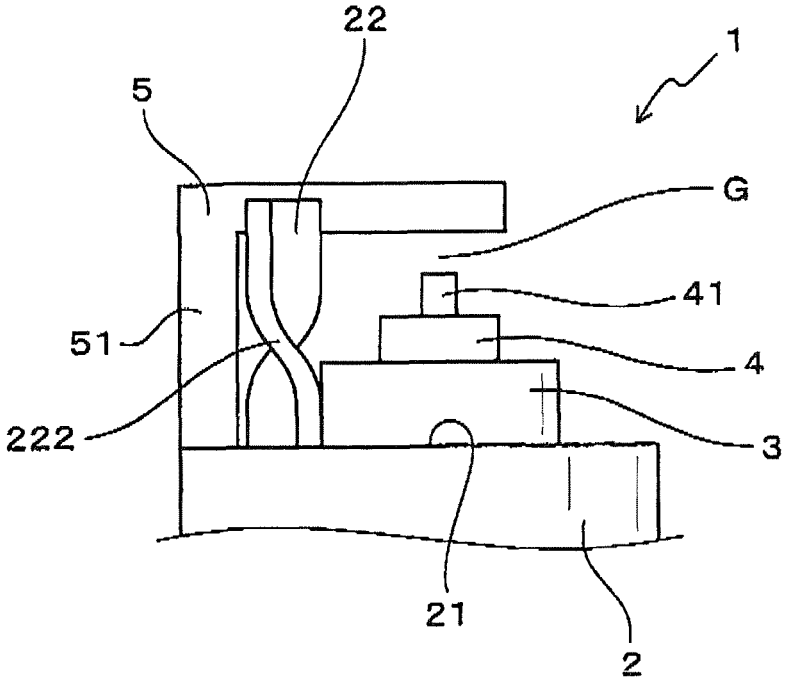
FIG. 34 is a side view of the distal part of the spark plug according to the ninth embodiment.

In this embodiment, as shown in FIGS. 32-34, the guide member 22 is twisted to have a twisted portion 222.

Specifically, the guide member 22 has a proximal portion joined to the distal end 21 of the housing 2, a distal portion defining the guide surface 221 and the twisted portion 222 formed between the proximal and distal portions in the axial direction of the spark plug 1.

In addition, in the present embodiment, the twisted portion 222 is formed by twisting the quadrangular prism-shaped guide member 22, which has a rectangular cross section, about its central axis by substantially 90°.

It is preferable that the twisted portion 222 is formed on the proximal side of the spark gap G. In this case, the guide surface 221 can be formed over the entire axial length of the spark gap G. Further, it is more preferable that the twisted portion 222 is formed on the proximal side of the distal end of the insulator 3.

Moreover, as shown in FIG. 33, the guide member 22 has, at an axial position closest to the spark gap G, a cross section perpendicular to the axial direction of the spark plug 1 such that the radial width W20 of the cross section is greater than the circumferential width W2 of the cross section. In the present embodiment, for the guide member 22, "an axial position closest to the spark gap G" is equivalent to "the same axial position as the spark gap G". Accordingly, at the same axial position as the spark gap G, the distal portion of the guide member 22 which defines the guide surface 221 satisfies the following dimensional relationship: W20>W2.

Furthermore, the distal portion of the guide member 22 which defines the guide surface 221 protrudes radially inward from the inner surface of the housing 2, but does not protrude radially outward from the outer surface of the housing 2. On the other hand, the proximal portion of the guide member 22 which is joined to the distal end 21 of the housing 2 has its circumferential width greater than its radial width.

According to the present embodiment, it is also possible to achieve the same advantageous effects as described in the first embodiment.

Moreover, in the present embodiment, since the proximal portion of the guide member 22 has its circumferential width greater than its radial width, it is possible to join the proximal portion of the guide member 22 to the distal end 21 of the housing 2 over a wide contact area therebetween. Consequently, it is possible to secure a high joining strength between the guide member 22 and the housing 2. On the other hand, since the distal portion of the guide member 22 has its radial width W20 greater than its circumferential width W, it is possible to increase the area of the guide surface 221, thereby enhancing the function of the guide member 22 to guide the flow F of the air-fuel mixture in the combustion chamber to the spark gap G.

Tenth Embodiment

Figure 35:
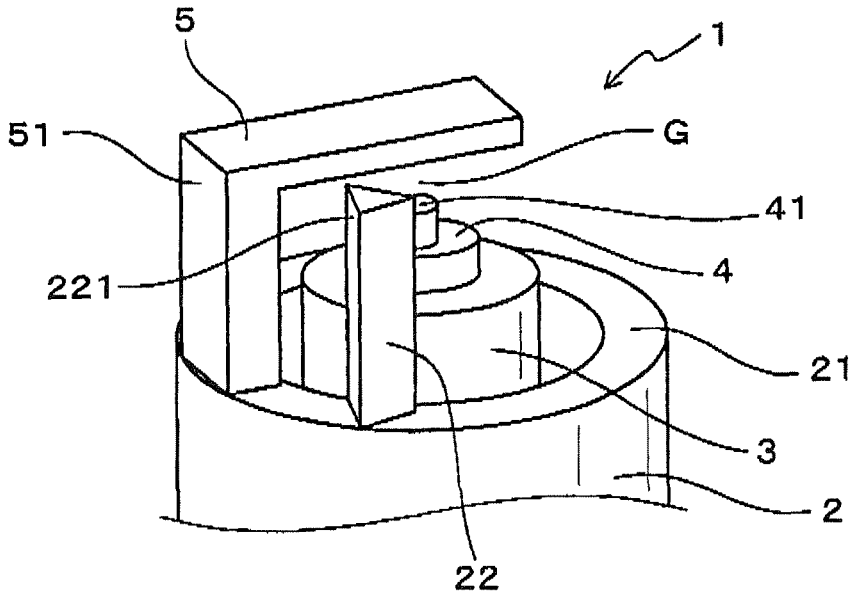
FIG. 35 is a perspective view of a distal part of a spark plug according to a tenth embodiment.
Figure 36:
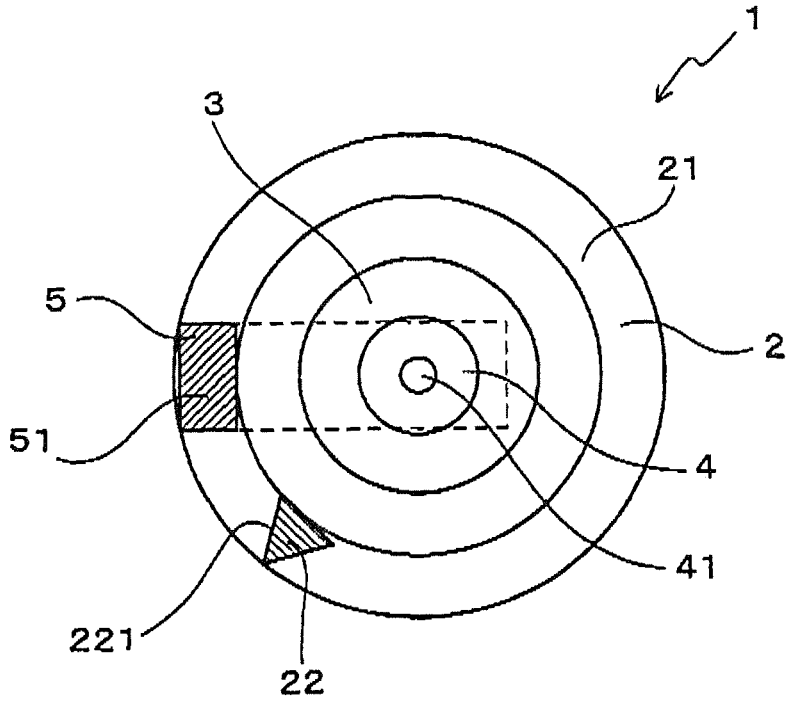
FIG. 36 is a cross-sectional view of the spark plug according to the tenth embodiment taken along a plane that extends perpendicular to an axial direction of the spark plug through a spark gap formed in the spark plug.

In this embodiment, as shown in FIGS. 35-36, the guide member 22 has a triangular cross section perpendicular to the axial direction of the spark plug 1. That is, the guide member 22 has the shape of a triangular prism.

More particularly, in the present embodiment, the shape of the cross section of the guide member 22 perpendicular to the axial direction of the spark plug 1 is an equilateral triangle. That is, the shape of the guide member 22 is a triangular prism with three identical rectangular side faces.

Moreover, the guide member 22 is arranged so that one of the three side faces of the guide member 22 constitutes the guide surface 221.

According to the present embodiment, it is also possible to achieve the same advantageous effects as described in the first embodiment.

Moreover, in the present embodiment, with the triangular prism shape of the guide member 22, it is possible to secure a wide area of the guide surface 221 while preventing the guide member 22 both from protruding radially inward from the inner surface of the housing 2 and from protruding radially outward from the outer surface of the housing 2. Consequently, it is possible to: prevent side sparks from occurring in the spark plug 1; ensure the mountability of the spark plug 1 to the engine, and enhance the function of the guide member 22 to guide the flow F of the air-fuel mixture in the combustion chamber to the spark gap G.

Eleventh Embodiment

Figure 37:
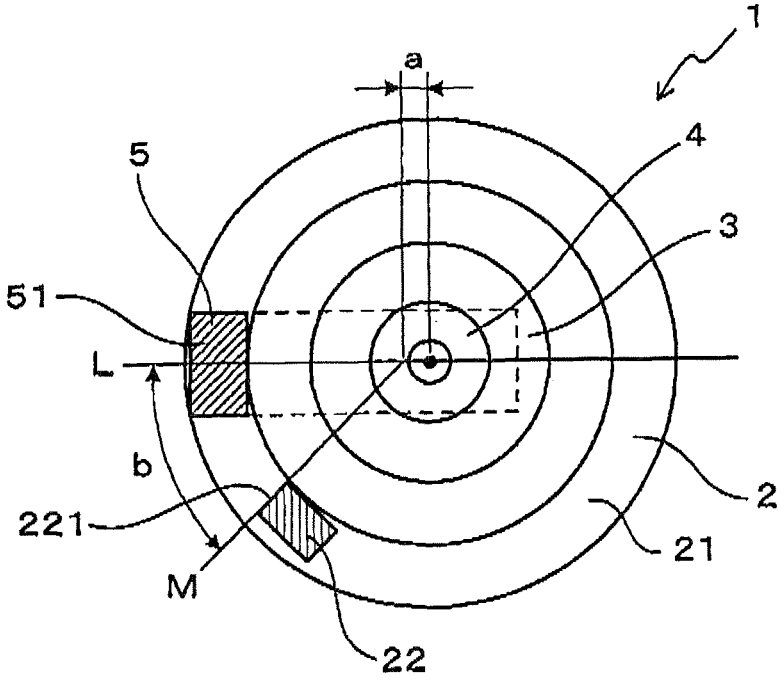
FIG. 37 is a cross-sectional view of a spark plug according to an eleventh embodiment taken along a plane that extends perpendicular to an axial direction of the spark plug through a spark gap formed in the spark plug.

In this embodiment, as shown in FIG. 37, the guide member 22 has the shape of a quadrangular prism so that the shape of a cross section of the guide member 22 perpendicular to the axial direction of the spark plug 1 is rectangular. That is, the guide member 22 has two wider side faces and two narrower side faces.

Moreover, the guide member 22 is arranged so that one of the two narrower side faces of the guide member 22 constitutes the guide surface 221. Accordingly, in the present embodiment, the straight line M is defined to extend through that one of the narrower side faces of the guide member 22 which constitutes the guide surface 221.

In addition, in the present embodiment, the guide member 22 is arranged so that at least the dimensional relationships (1)-(4) and the three-dimensional shape requirement are satisfied in the spark plug 1.

According to the present embodiment, it is possible to achieve the same advantageous effects as described in the first embodiment.

While the above particular embodiments have been shown and described, it will be understood by those skilled in the art that various modifications, changes, and improvements may be made without departing from the spirit of the present invention.

What is claimed is:

1. A spark plug for an internal combustion engine, the spark plug comprising:

a tubular housing:

a tubular insulator retained in the housing;

a center electrode secured in the insulator with a distal end portion of the center electrode protruding outside the insulator;

a ground electrode having a standing portion that stands distalward from a distal end of the housing and an opposing portion that opposes the distal end portion of the center electrode in an axial direction of the spark plug through a spark gap formed therebetween; and a guide member configured to guide the flow of an air-fuel mixture in a combustion chamber of the internal combustion engine to the spark gap, the guide member protruding distalward from the distal end of the housing at a different circumferential position from the ground electrode, the guide member having a guide surface that faces the ground electrode in a circumferential direction of the spark plug, wherein on a projection plane which is defined to extend perpendicular to the axial direction of the spark plug through the spark gap and on which the above components of the spark plug are projected, the following dimensional relationships are satisfied:

$$b \geq -67.8 \times (a/D) + 27.4 \quad (1)$$

$$b \leq -123.7 \times (a/D) + 64.5 \quad (2)$$

$$-0.4 \leq (a/D) \leq 0.4 \quad (3)$$

$$0° \leq b \leq 90° \quad (4)$$

where a is a distance between a center point of the center electrode and an intersection point between straight lines L and M, the straight line L extending through both a center of the standing portion of the ground electrode in the circumferential direction of the spark plug and the center point of the center electrode, the straight line M extending through the guide surface of the guide member, the distance a being positive on the side of the center point of the center electrode away from the standing portion of the ground electrode and negative on the side of the center point of the center electrode approaching the standing portion of the ground electrode, b is an angle between the straight lines L and M, and D is an outer diameter of the housing, wherein a first reference plane P1 is defined to include both a central axis of the center electrode and the straight line L, a second reference plane P2 is defined to extend perpendicular to the axial direction of the spark plug through a distal end of the center electrode, a third reference plane P3 is defined to be orthogonal to the first reference plane P1 and extend obliquely at an oblique angle θ with respect to the second reference plane P2 through the intersection between the central axis of the center electrode and the second reference plane P2, the oblique angle θ is positive when the third reference plane P3 is inclined with respect to the second reference plane P2 in a direction causing a distal-side face of the third reference plane P3 not to face the standing portion of the ground electrode, with the oblique angle θ being in a range of 0 to 30° and projecting on the projection plane a cross section of the ground electrode and a cross section of the guide member both of which are taken along the third reference plane P3, the following dimensional relationship is further satisfied:

$$0.8 \leq r/R \leq 1 \quad (5)$$

where r is a distance on the projection plane between the central axis of the center electrode and an outer side of the cross section of the ground electrode, and R is a distance on the projection plane between the central axis of the center electrode and a guide surface-side outer corner of the cross section of the guide member.

2. The spark plug as set forth in claim 1, wherein the following dimensional relationship is further satisfied:

$$b \leq -123.4 \times (a/D) + 53.7 \quad (6).$$

3. The spark plug as set forth in claim 2, wherein the following dimensional relationship is further satisfied:

$$b \geq -123.1 \times (a/D) + 30.0 \quad (7).$$

4. The spark plug as set forth in claim 3, wherein the following dimensional relationship is further satisfied:

$$-0.3 \leq (a/D) \leq 0.3 \quad (8).$$

5. The spark plug as set forth in claim 4, wherein the standing portion of the round electrode includes an axially-extending part that extends from the distal end of the housing in the axial direction of the spark plus and the following dimensional relationship is further satisfied:

$$h2 \geq h1 + R \times \tan 30° \quad (9)$$

where h1 is an axial distance from the distal end of the housing to the distal end of the center electrode, and h2 is an axial length of the axially-extending part of the standing portion of the ground electrode.

6. The spark plug as set forth in claim 5, wherein the guide member extends obliquely with respect to the axial direction of the spark plug so that the distance between the guide member and the central axis of the center electrode decreases in a distalward direction.

7. The spark plug as set forth in claim 1, wherein the following dimensional relationship is further satisfied:

$$b \geq -123.1 \times (a/D) + 30.0 \quad (7).$$

8. The spark plug as set forth in claim 1, wherein the following dimensional relationship is further satisfied:

$$-0.3 \leq (a/D) \leq 0.3 \quad (8).$$

9. The spark plug as set forth in claim 1, wherein the standing portion of the ground electrode includes an axially-extending part that extends from the distal end of the housing in the axial direction of the spark plug, and the following dimensional relationship is further satisfied:

$$h2 \geq h1 + R \times \tan 30° \quad (9)$$

where h1 is an axial distance from the distal end of the housing to the distal end of the center electrode, and h2 is an axial length of the axially-extending part of the standing portion of the ground electrode.

10. The spark plug as set forth in claim 1, wherein the guide member extends obliquely with respect to the axial direction of the spark plug so that the distance between the guide member and the central axis of the center electrode decreases in a distalward direction.

11. The spark plug as set forth in claim 1, wherein $0.85 \leq r/R \leq 1$.

12. The spark plug as set forth in claim 11, wherein $0.9 \leq r/R \leq 1$.

13. The spark plug as set forth in claim 1, wherein the guide member has its distal end located at the same axial position as or proximalward from a distal end of the ground electrode and at the same axial position as or distalward from a distal end of the insulator.

14. The spark plug as set forth in claim 1, wherein a circumferential width of the guide member is smaller than a circumferential width of the standing portion of the ground electrode.

15. The spark plug as set forth in claim 1, wherein the guide member extends in the axial direction of the spark plug.

16. The spark plug as set forth in claim 1, wherein a radial width of the guide member is greater than a circumferential width of the guide member.

* * * * *